US011130025B2

(12) United States Patent
Bacon et al.

(10) Patent No.: US 11,130,025 B2
(45) **Date of Patent: *Sep. 28, 2021**

(54) GOLF CLUB HEADS WITH ENERGY STORAGE FEATURES

(71) Applicant: KARSTEN MANUFACTURING CORPORATION, Phoenix, AZ (US)

(72) Inventors: Cory S. Bacon, Cave Creek, AZ (US); Eric J. Morales, Laveen, AZ (US); Ryan M. Stokke, Anthem, AZ (US); Calvin S. Wang, Chandler, AZ (US); Xiaojian Chen, Phoenix, AZ (US); Travis D. Milleman, Portland, OR (US); Martin R. Jertson, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/203,433

(22) Filed: Nov. 28, 2018

(65) Prior Publication Data

US 2019/0091526 A1 Mar. 28, 2019

Related U.S. Application Data

(63) Continuation-in-part of application No. 15/804,812, filed on Nov. 6, 2017, and a continuation-in-part of application No. 15/435,054, filed on Feb. 16, 2017, said application No. 15/804,812 is a continuation of application No. 15/004,541, filed on Jan. 22, 2016, now Pat. No. 9,839,818, application No. 16/203,433, (Continued)

(51) Int. Cl.

| | |
|---|---|
| ***A63B 53/04*** | (2015.01) |
| ***A63B 53/06*** | (2015.01) |
| ***A63B 1/00*** | (2006.01) |

(52) U.S. Cl.

CPC ..... *A63B 53/0466* (2013.01); *A63B 1/00* (2013.01); *A63B 53/0408* (2020.08); *A63B 53/0437* (2020.08)

(58) Field of Classification Search

CPC ..... A63B 53/04
USPC ..... 473/332, 345, 349, 250
See application file for complete search history.

(56) References Cited

U.S. PATENT DOCUMENTS 5,213,328 A * 5/1993 Long ..... A63B 60/00 473/346
5,482,279 A * 1/1996 Antonious ..... A63B 60/00 473/327

(Continued)

OTHER PUBLICATIONS

International Search Report and Written Opinion of Corresponding U.S. Appl. No. 14/920,484, entitled "Golf Club Heads With Energy Storage Characteristics," filed Oct. 22, 2015.

(Continued)

*Primary Examiner* — William M Pierce

(57) ABSTRACT

Embodiments of a golf club head with a plurality of energy storage features are presented herein. In some embodiments, a golf club head comprises a body comprising a strike face, a heel region, a toe region opposite the heel region, a sole, a crown, a channel, a chamfer spanning between a strike face and the crown, and an internal radius transition feature from the strike face to at least one of the sole or the crown.

18 Claims, 10 Drawing Sheets

Related U.S. Application Data which is a continuation-in-part of application No. 14/920,480, filed on Oct. 22, 2015, now Pat. No. 10,688,350, said application No. 15/435,054 is a continuation-in-part of application No. 14/920,484, filed on Oct. 22, 2015, now abandoned.

(60) Provisional application No. 62/595,130, filed on Dec. 6, 2017, provisional application No. 62/591,889, filed on Nov. 29, 2017, provisional application No. 62/591,682, filed on Nov. 28, 2017, provisional application No. 62/313,215, filed on Mar. 25, 2016, provisional application No. 62/295,565, filed on Feb. 16, 2016, provisional application No. 62/206,152, filed on Aug. 17, 2015, provisional application No. 62/131,739, filed on Mar. 11, 2015, provisional application No. 62/107,269, filed on Jan. 23, 2015, provisional application No. 62/105,464, filed on Jan. 20, 2015, provisional application No. 62/105,460, filed on Jan. 20, 2015, provisional application No. 62/068,232, filed on Oct. 24, 2014.

(56) References Cited

U.S. PATENT DOCUMENTS 5,718,641 A * 2/1998 Lin ..... A63B 53/04 473/224
5,941,782 A * 8/1999 Cook ..... A63B 53/04 473/346
6,348,013 B1 2/2002 Kosmatka
6,383,090 B1 5/2002 O'Doherty
6,572,491 B2 6/2003 Hasebe
6,852,038 B2 * 2/2005 Yabu ..... A63B 53/04 473/224
6,971,961 B2 12/2005 Chen
7,377,861 B2 5/2008 Tateno
7,431,668 B2 10/2008 Tateno
7,435,191 B2 10/2008 Tateno
7,448,964 B2 11/2008 Schweigert et al.
7,455,597 B2 * 11/2008 Matsunaga ..... A63B 60/02 473/329
7,470,200 B2 12/2008 Sanchez
7,500,924 B2 * 3/2009 Yokota ..... A63B 53/0466 473/332
7,503,853 B2 3/2009 Matsunaga
7,513,836 B2 4/2009 Matsunaga
7,588,504 B2 9/2009 Matsunaga
7,798,915 B2 9/2010 Matsunaga
8,109,842 B2 2/2012 Matsunaga
8,182,365 B2 5/2012 Wada
8,403,771 B1 * 3/2013 Rice ..... A63B 53/04 473/328
8,647,217 B2 2/2014 Nishio
8,651,975 B2 2/2014 Soracco
8,657,703 B2 2/2014 Wada
8,834,290 B2 * 9/2014 Bezilla ..... A63B 53/0466 473/329
8,870,681 B2 10/2014 Yamamoto
8,932,149 B2 1/2015 Oldknkow
8,956,242 B2 * 2/2015 Rice ..... A63B 53/0466 473/329
8,986,133 B2 3/2015 Bennett et al.
9,017,187 B2 * 4/2015 Abe ..... A63B 60/52 473/329
9,079,078 B2 7/2015 Greensmith et al.
9,089,747 B2 7/2015 Boyd et al.
9,089,749 B2 7/2015 Burnett et al.
9,168,435 B1 * 10/2015 Boggs ..... A63B 53/04
9,320,949 B2 4/2016 Golden
9,415,280 B2 8/2016 Stokke et al.
9,636,552 B2 * 5/2017 Cleghorn ..... A63B 60/54
9,682,293 B2 6/2017 Bennett
9,700,765 B2 7/2017 Frame
9,914,030 B2 * 3/2018 Cleghorn ..... A63B 53/0466
9,937,389 B2 * 4/2018 Kitagawa ..... A63B 53/0466
9,937,390 B2 * 4/2018 Luttrell ..... A63B 53/06
9,937,396 B2 4/2018 Stites et al.
9,950,219 B2 * 4/2018 Larson ..... A63B 53/0466
10,357,695 B2 * 7/2019 Boggs
10,471,311 B2 * 11/2019 Kato ..... A63B 53/0466
2002/0065146 A1 * 5/2002 Kusumoto ..... A63B 53/04 473/345
2004/0009830 A1 * 1/2004 Nishio ..... A63B 53/0466 473/345
2004/0087388 A1 5/2004 Beach
2007/0026961 A1 * 2/2007 Hou ..... A63B 53/0466 473/329
2007/0117648 A1 * 5/2007 Yokota ..... A63B 53/0466 473/328
2010/0041494 A1 * 2/2010 Boyd ..... A63B 53/04 473/342
2011/0053703 A1 * 3/2011 Stites ..... A63B 53/0466 473/291
2011/0183776 A1 7/2011 Breier et al.
2011/0207551 A1 * 8/2011 Breier ..... A63B 53/047 473/332
2012/0289360 A1 * 11/2012 Breier ..... A63B 53/047 473/335
2013/0109500 A1 * 5/2013 Boyd ..... A63B 53/047 473/332
2013/0225319 A1 * 8/2013 Kato ..... A63B 53/047 473/331
2013/0281229 A1 10/2013 Su
2013/0288820 A1 * 10/2013 Shimahara ..... A63B 60/00 473/331
2013/0331201 A1 * 12/2013 Wahl ..... A63B 53/0475 473/329
2014/0080634 A1 * 3/2014 Golden ..... A63B 60/00 473/345
2015/0094166 A1 * 4/2015 Taylor ..... A63B 53/0466 473/335
2015/0217167 A1 * 8/2015 Frame ..... A63B 53/0466 473/329
2016/0008677 A1 * 1/2016 Kitagawa ..... A63B 53/0466 473/331
2016/0008678 A1 * 1/2016 Kitagawa ..... A63B 53/0466 473/331
2016/0059094 A1 * 3/2016 Mata ..... A63B 53/02 473/329
2016/0096081 A1 * 4/2016 Boggs ..... A63B 53/04 473/324
2016/0096082 A1 * 4/2016 Boggs ..... A63B 53/04 473/324
2016/0096085 A1 * 4/2016 Boggs ..... A63B 53/0466 473/350
2016/0193508 A1 * 7/2016 Issertell ..... A63B 53/047 473/342
2016/0213985 A1 * 7/2016 Jertson ..... A63B 53/0466
2016/0367876 A1 * 12/2016 Taylor ..... A63B 60/54
2017/0072277 A1 * 3/2017 Mata ..... A63B 53/06
2018/0133566 A1 * 5/2018 Kitagawa ..... A63B 53/0466
2019/0076705 A1 * 3/2019 Greaney ..... A63B 60/02
2019/0091526 A1 * 3/2019 Bacon ..... A63B 1/00
2019/0255394 A1 * 8/2019 Boggs ..... A63B 53/04

OTHER PUBLICATIONS http://www.golfwrx.com/322138/you-can-see-inside-cobras-king-ltd-drivers-andfairway-woods/, "You can see inside Cobra's King Ltd drivers and fairway woods." Zak Kozuchowski, Accessed on Oct. 15, 2015.

International Search Report and Written Opinion of Corresponding U.S. Appl. No. PCT/US2017/018197, entitled "Golf Club Heads With Energy Storage Characteristics," filed Feb. 16, 2017.

* cited by examiner

300

GOLF CLUB HEADS WITH ENERGY STORAGE FEATURES

CROSS-REFERENCE TO RELATED APPLICATIONS

This is a continuation-in part of U.S. Non-Provisional patent application Ser. No. 15/804,812 filed on Nov. 6, 2017, which is a continuation of U.S. Non-Provisional patent application Ser. No. 15/004,541 filed on Jan. 22, 2016, which claims benefit of U.S. Provisional Patent Application No. 62/107,269, filed on Jan. 23, 2015, the entire contents of which are incorporated herein by reference.

This also is a continuation-in part of U.S. Non-Provisional patent application Ser. No. 14/920,480, filed on Oct. 22, 2015, which is a non-provisional of U.S. Provisional Application No. 62/206,152, filed Aug. 17, 2015, U.S. Provisional Application No. 62/131,739, filed Mar. 11, 2015, U.S. Provisional Application No. 62/105,460, filed Jan. 20, 2015, U.S. Provisional Application No. 62/105,464, filed Jan. 20, 2015, and U.S. Provisional Application No. 62/068,232, filed Oct. 24, 2014, the entire contents of which are incorporated herein by reference.

This also is a continuation-in part of U.S. Non-Provisional patent application Ser. No. 15/435,054, filed on Feb. 16, 2017, which is a continuation-in part of U.S. patent application Ser. No. 14/920,484, filed on Oct. 22, 2015, which claims the benefit of U.S. Provisional Application No. 62/206,152, filed Aug. 17, 2015, U.S. Provisional Application No. 62/131,739, filed Mar. 11, 2015, U.S. Provisional Application No. 62/105,460, filed Jan. 20, 2015, U.S. Provisional Application No. 62/105,464, filed Jan. 20, 2015, and U.S. Provisional Application No. 62/068,232, filed Oct. 24, 2014. U.S. Non-Provisional patent application Ser. No. 15/435,054 also claims the benefit of U.S. Provisional Patent Application No. 62/295,565, filed on Feb. 16, 2016, and U.S. Provisional Patent Application No. 62/313,215, filed on Mar. 25, 2016, the entire contents of which are incorporated herein by reference.

This also claims the benefit of U.S. Provisional Application No. 62/591,682, filed on Nov. 28, 2017, U.S. Provisional Application No. 62/591,889, filed on Nov. 29, 2017, and U.S. Provisional Application No. 62/595,130, filed on Dec. 6, 2017, the entire contents of which are incorporated herein by reference.

FIELD OF INVENTION

This disclosure relates generally to golf clubs and relates more particularly to golf club heads with energy storage features, including a channel, chamfer, and internal radius transition region.

BACKGROUND

Golf club heads are designed to optimize performance characteristics, such as ball spin, ball speed, and travel distance. In low lofted clubs (e.g. hollow body club heads such as drivers, fairway woods, and hybrids), while a certain amount of backspin is needed to generate sufficient lift to keep the ball in the air, too much backspin can negatively affect overall carry distance. For example, when comparing two golf balls struck at the same speed, with different amounts of back spin, the one with more backspin will not travel as far, as the Magnus effect causes the ball to travel higher, but results in a steeper, more rapid descent. However, current methods to reduce ball spin and increase ball speed can affect other performance qualities of the club head such as club head durability. There is a need in the art for a club head having reduced back spin and increased energy storage, resulting in increased ball speed, without sacrificing durability.

BRIEF DESCRIPTION OF THE DRAWINGS

To facilitate further description of the embodiments, the following drawings are provided in which.

Figure 1:
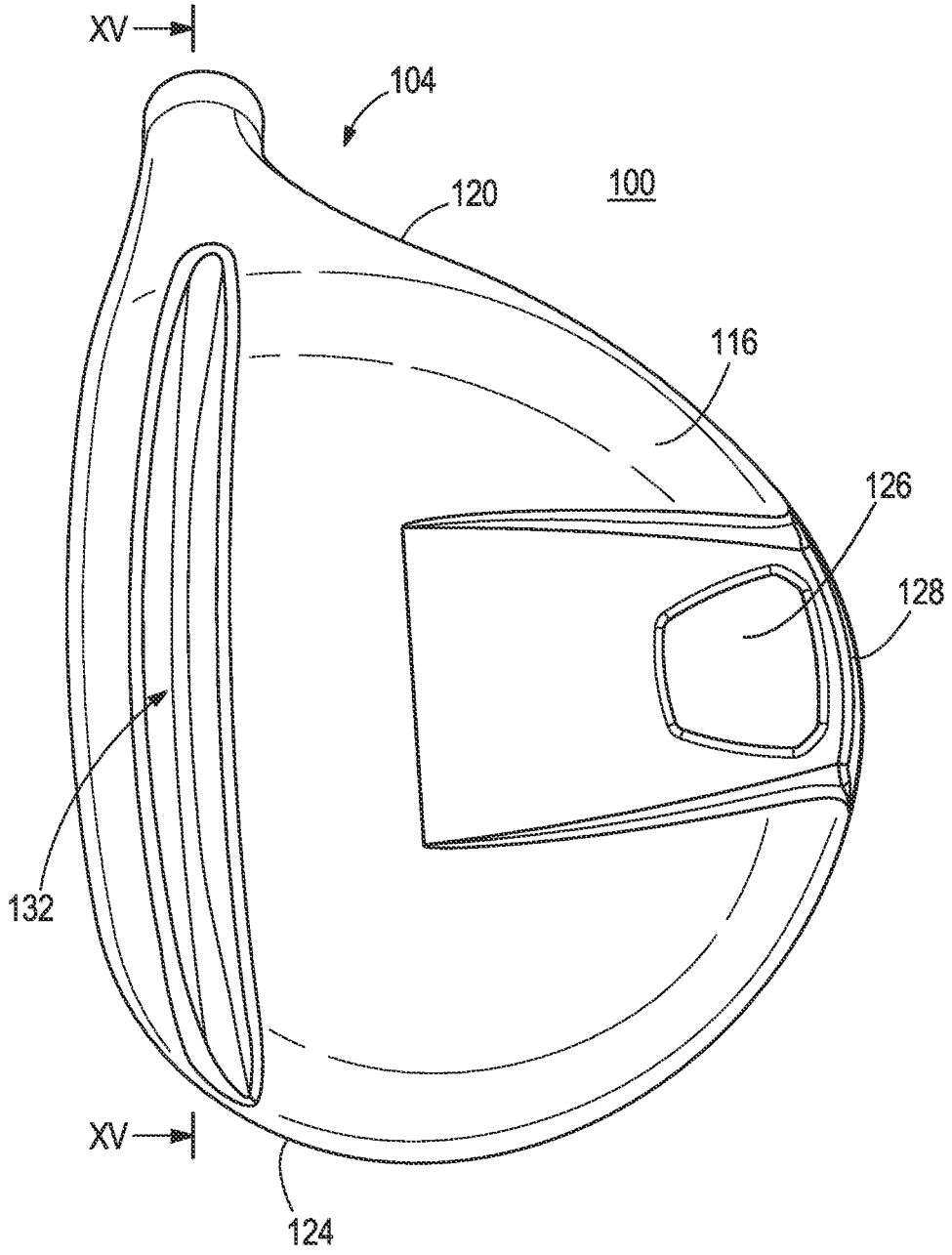
FIG. 1 illustrates a bottom view of a golf club head having a sole channel.

Other aspects of the disclosure will become apparent by consideration of the detailed description and accompanying drawings.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures are not necessarily drawn to scale. For example, the dimensions of some of the elements in the figures may be exaggerated relative to other elements to help improve understanding of embodiments of the present disclosure. The same reference numerals in different figures denote the same elements.

DETAILED DESCRIPTION

Described herein a golf club head having a plurality of energy storage features. The golf club head comprises any one or combination of the following: a cambered channel in a portion of a crown or a sole, a chamfer spanning between a strike face and the crown, and an internal radius transition feature from the strike face to at least one of the sole or the crown. The plurality of energy storage devices increase the deflection of the strike face, without compromising the structural integrity of the strike face, thus increasing the internal energy of the golf club head. An increase in internal energy of the golf club head, leads to improvements in overall ball speed of a golf ball struck by the golf club head.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the invention described herein are, for example, capable of operation in other orientations than those illustrated or otherwise described herein.

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways.

Described herein are various embodiments of a golf club head having one or more energy storage features. The energy storage features can comprise one or more channels, one or more chamfers, and one or more internal radius transition features. One embodiment of the club head includes a channel in a portion of the crown or the sole. In these or other embodiments, the club head can include a chamfer spanning between a strike face and the crown. Further, in these or other embodiments, the club head can include an internal radius transition feature from the strike face to at least one of the sole or the crown. In many embodiments, the golf club head can be wood type golf club head (i.e. driver, fairway wood, hybrid).

In some embodiments, the club head can comprise a driver. In these embodiments, the loft angle of the club head can be less than approximately 16 degrees, less than approximately 15 degrees, less than approximately 14 degrees, less than approximately 13 degrees, less than approximately 12 degrees, less than approximately 11 degrees, or less than approximately 10 degrees. Further, in these embodiments, the volume of the club head can be greater than approximately 400 cc, greater than approximately 425 cc, greater than approximately 450 cc, greater than approximately 475 cc, greater than approximately 500 cc, greater than approximately 525 cc, greater than approximately 550 cc, greater than approximately 575 cc, greater than approximately 600 cc, greater than approximately 625 cc, greater than approximately 650 cc, greater than approximately 675 cc, or greater than approximately 700 cc. In some embodiments, the volume of the club head can be approximately 400 cc-600 cc, 425 cc-500 cc, approximately 500 cc-600 cc, approximately 500 cc-650 cc, approximately 550 cc-700 cc, approximately 600 cc-650 cc, approximately 600 cc-700 cc, or approximately 600 cc-800 cc.

In some embodiments, the club head can comprise a fairway wood. In these embodiments, the loft angle of the club head can be less than approximately 35 degrees, less than approximately 34 degrees, less than approximately 33 degrees, less than approximately 32 degrees, less than approximately 31 degrees, or less than approximately 30 degrees. Further, in these embodiments, the loft angle of the club head can be greater than approximately 12 degrees, greater than approximately 13 degrees, greater than approximately 14 degrees, greater than approximately 15 degrees, greater than approximately 16 degrees, greater than approximately 17 degrees, greater than approximately 18 degrees, greater than approximately 19 degrees, or greater than approximately 20 degrees. For example, in some embodiments, the loft angle of the club head can be between 12 degrees and 35 degrees, between 15 degrees and 35 degrees, between 20 degrees and 35 degrees, or between 12 degrees and 30 degrees.

In embodiments where the club head comprises a fairway wood, the volume of the club head is less than approximately 400 cc, less than approximately 375 cc, less than approximately 350 cc, less than approximately 325 cc, less than approximately 300 cc, less than approximately 275 cc, less than approximately 250 cc, less than approximately 225 cc, or less than approximately 200 cc. In these embodiments, the volume of the club head can be approximately 150 cc-200 cc, approximately 150 cc-250 cc, approximately 150 cc-300 cc, approximately 150 cc-350 cc, approximately 150 cc-400 cc, approximately 300 cc-400 cc, approximately 325 cc-400 cc, approximately 350 cc-400 cc, approximately 250 cc-400 cc, approximately 250 cc-350 cc, or approximately 275 cc-375 cc.

In some embodiments, the club head can comprise a hybrid. In these embodiments, the loft angle of the club head can be less than approximately 40 degrees, less than approximately 39 degrees, less than approximately 38 degrees, less than approximately 37 degrees, less than approximately 36 degrees, less than approximately 35 degrees, less than approximately 34 degrees, less than approximately 33 degrees, less than approximately 32 degrees, less than approximately 31 degrees, or less than approximately 30 degrees. Further, in these embodiments, the loft angle of the club head can be greater than approximately 16 degrees, greater than approximately 17 degrees, greater than approximately 18 degrees, greater than approximately 19 degrees, greater than approximately 20 degrees, greater than approximately 21 degrees, greater than approximately 22 degrees, greater than approximately 23 degrees, greater than approximately 24 degrees, or greater than approximately 25 degrees.

In embodiments where the club head comprises a hybrid, the volume of the club head is less than approximately 200 cc, less than approximately 175 cc, less than approximately 150 cc, less than approximately 125 cc, less than approximately 100 cc, or less than approximately 75 cc. In some embodiments, the volume of the club head can be approximately 100 cc-150 cc, approximately 75 cc-150 cc, approximately 100 cc-125 cc, or approximately 75 cc-125 cc.

FIGS. 1-5 illustrate an embodiment of a golf club head 100 having a body 104, strike face 108, and one or more energy storage features. The body comprises a crown 112, a sole 116, a heel region 120, a toe region 124, and a rear portion 128. Together, the strike face 108, the crown 112, the sole 116, the heel region 120, the toe region 124, and the rear portion 128 form a hollow interior of the club head 100.

In some embodiments, the body 104 of the golf club head 100 can comprise stainless steel, titanium, aluminum, a steel alloy (e.g. 455 steel, 475 steel, 431 steel, 17-4 stainless steel, maraging steel), a titanium alloy (e.g. Ti 7-4, Ti 6-4, T-9S), an aluminum alloy, or a composite material. In some embodiments, the strike face 108 of the golf club head 100 can comprise stainless steel, titanium, aluminum, a steel alloy (e.g. 455 steel, 475 steel, 431 steel, 17-4 stainless steel, maraging steel), a titanium alloy (e.g. Ti 7-4, Ti 6-4, T-9S), an aluminum alloy, or a composite material. In other embodiments, the body 104 can comprise the same material as strike face 108. In some embodiments, the body 104 can comprise a different material than strike face 108.

Figure 2:
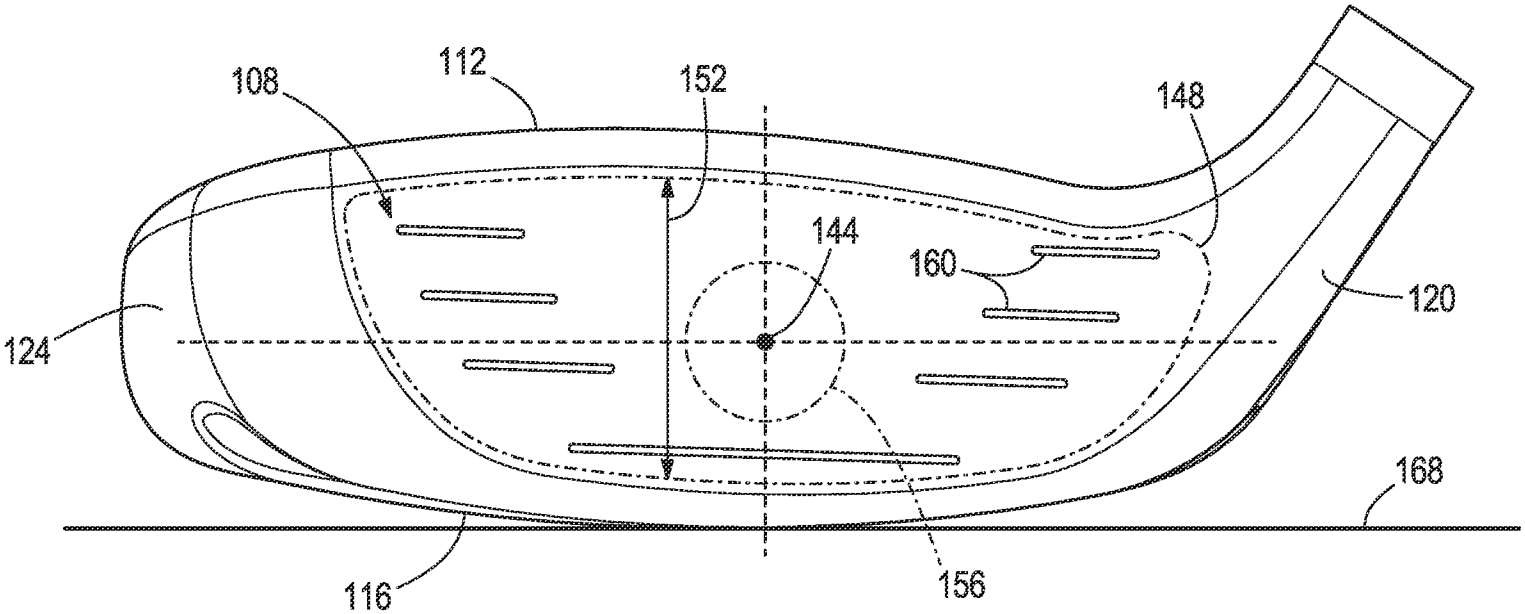
FIG. 2 illustrates a front view of the golf club head of FIG. 1.
Figure 3:
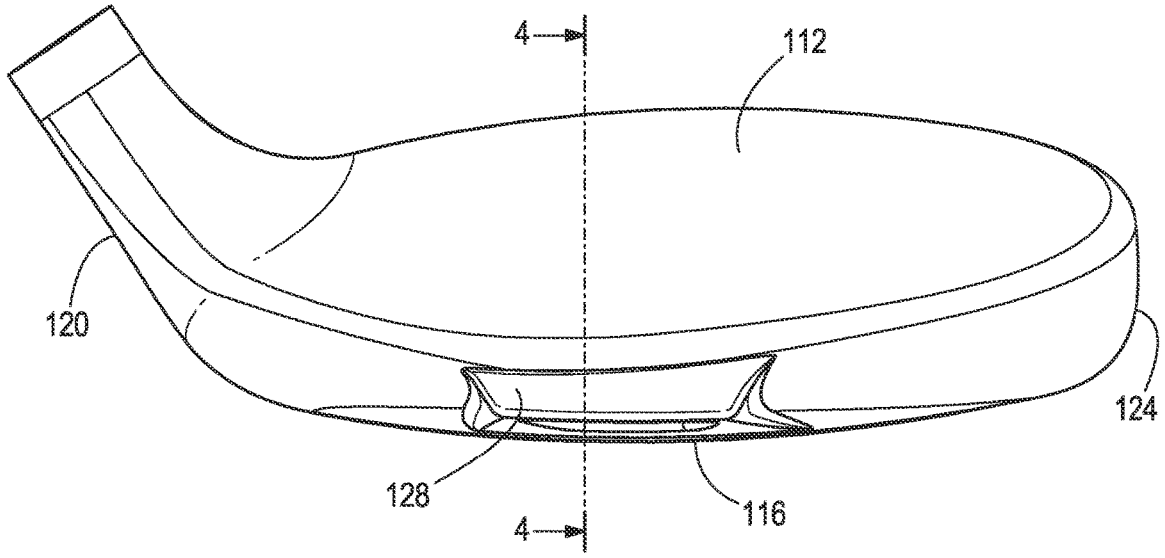
FIG. 3 illustrates a rear view of the golf club head of FIG. 1.

With reference to FIG. 2, the strike face 108 has a centerpoint 144, a perimeter 148, and a face height 152. In one construction, the centerpoint 144 is located at a geometric centerpoint of the perimeter 148 and at a midpoint of the face height 152. In the same or other constructions, the centerpoint 144 also can be centered with respect to an engineered impact zone 156, which can be defined by a region of grooves 160 on the strike face 108. In other constructions, the centerpoint 144 can be located in accordance with the definition of a golf governing body such as the United States Golf Association (USGA). For example, the centerpoint 144 can be determined in accordance with Section 6.1 of the USGA's Procedure for Measuring the Flexibility of a Golf Clubhead (USGA-TPX3004, Rev. 1.0.0, May 1, 2008) (available at http://www.usga.org/equipment/testing/protocols/Procedure-For-Measuring-The-Flexibility-Of-A-Golf-Club-Head/) (the "Flexibility Procedure").

Figure 4:
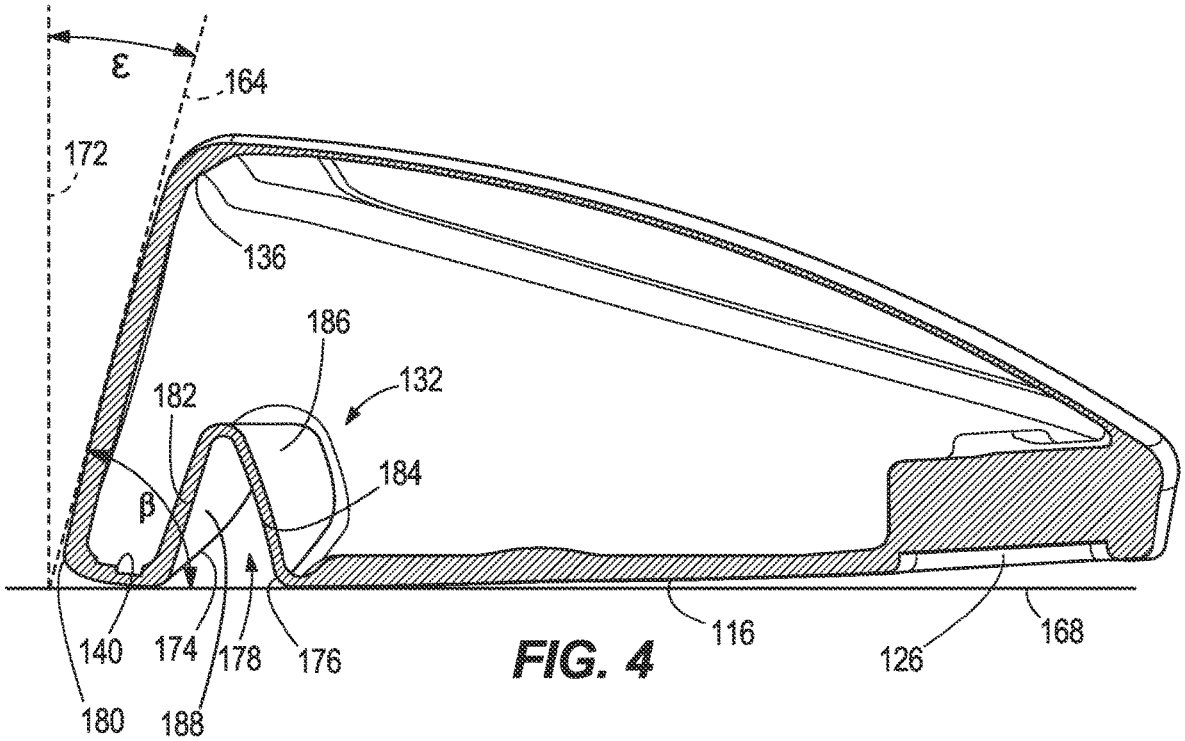
FIG. 4 illustrates a side cross-sectional view of the golf club head of FIG. 1 across line 4-4 of FIG. 3, showing the chamfer, the sole channel, and the internal radius transition feature.

With further reference to FIGS. 2 and 4, the golf club head 100 comprises a loft plane 164, which is at least tangent to the centerpoint 144 of the strike face 108. The loft plane 164 is oriented at an angle β with respect to a ground plane 168 and an angle ε with respect to an axis 172 that is perpendicular to the ground plane 168. The face height 152 can be measured parallel to the loft plane 164, in a crown 112 to sole 116 direction, between a maximum point of the perimeter 148 and a minimum point of the perimeter 148. The face height 152 varies depending on the type of club. For example, the face height 152 for a fairway wood can be approximately 35 millimeters (mm), while the face height 152 for a driver can be approximately 50 mm, and the face height 152 for a hybrid can be approximately 25 mm. The face height 152 for additional or alternative fairway woods may range from 25-50 mm in the present or other examples, while the face height 152 for additional or alternative drivers may range from 40-80 mm and the face height 152 for additional or alternative hybrids may range from 15-45 mm. In additional or alternative constructions, the perimeter 148 of the strike face 108, comprising at least the first end and the second end defining the face height 152, may include alternative configurations other than illustrated herein.

The club head 100 further includes one or more energy storage features. The energy storage feature can be a channel 132 in a portion of the crown 112 or the sole 116. The energy storage feature can be a chamfer 136 spanning between the strike face 108 and the crown 112. The energy storage feature can be an internal radius transition feature 140 from the strike face 108 to at least one of the sole 116 and the crown 112.

i. Chamfer

Figure 9:
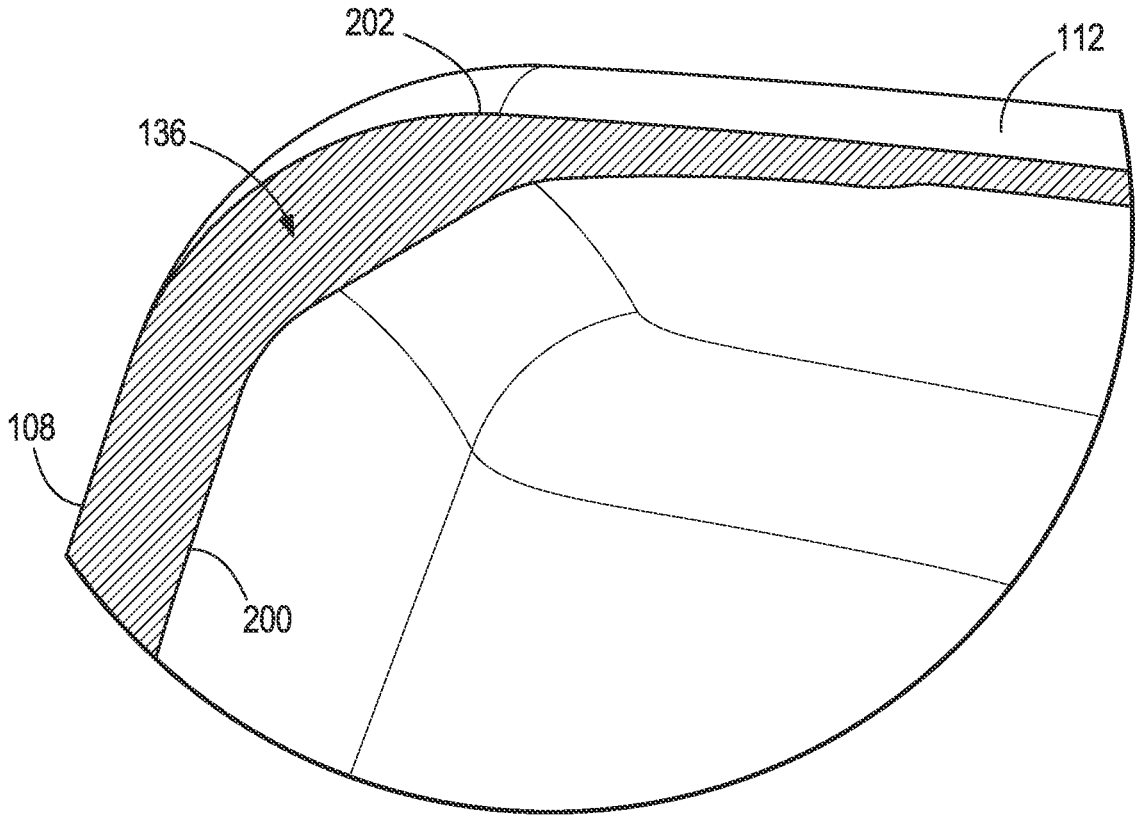
FIG. 9 illustrates an enlarged cross-sectional view of a chamfer in the golf club head of FIG. 1.
Figure 10:
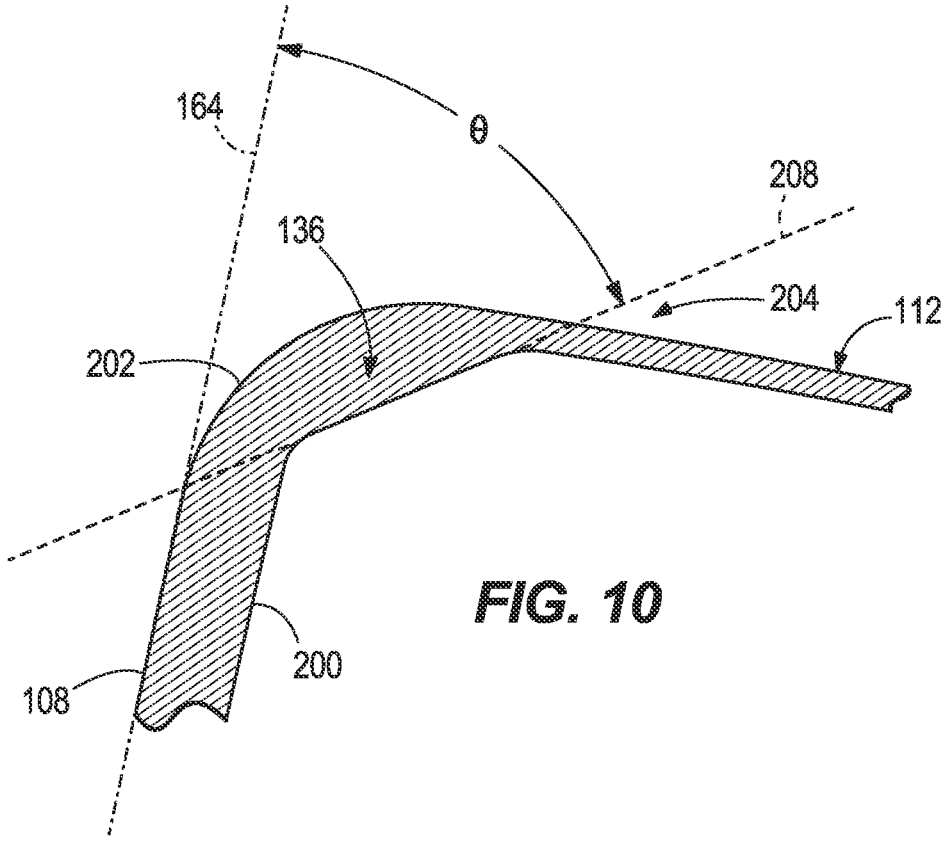
FIG. 10 illustrates an enlarged cross-sectional view of a chamfer in the golf club head of FIG. 1.

In some embodiments, the one or more energy storage features can comprise a chamfer. Referring to FIGS. 4, 9, and 10, the golf club head 100 can comprise a chamfer 136 spanning between the strike face 108 and the crown 112. The chamfer 136, having an inner surface 200, defines a hinge point 204 of the crown 112. The chamfer 136 defines a chamfer plane 208, and an angle between the chamfer plane 208 and the loft plane 164 can be approximately 45 degrees. The chamfer 136 shifts the hinge point 204 toward a rear portion 128 of the club head 100 and allows increased bending of the crown 112 and strike face 108 of the club head 100 on impact with a golf ball compared to a similar club head without a chamfer. Increased bending of the crown 112 and strike face 108 allow increased energy transfer to the golf ball and/or reduced spin on the golf ball resulting in increased travel distance.

In some embodiments, the strike face 108 defines a loft plane 136 and the hinge point 204 is spaced apart from the loft plane 136 by a minimum of approximately 0.16 inches in a direction perpendicular to the loft plane 136. Further, in these or other embodiments, the chamfer 136 defines a plane 212 tangent to the inner surface 200 of the chamfer 136, and an angle between the chamfer plane 208 and the loft plane 164 can be approximately 45 degrees. In these or other embodiments, the chamfer 136 can provide spin reduction of 100-400 revolutions per minute (rpm) of a golf ball.

The chamfer 136 extends between the strike face 108 and the crown 112. The chamfer 136 includes an outer surface 202 and the inner surface 200 that define a thickness therebetween. The thickness may be consistent or may vary along the length of the chamfer 136. The thickness between the outer surface 202 and the inner surface 200 defines a thickened portion of the body 104 between the strike face 108 and the crown 112. The chamfer 136 defines a gently sloping outer surface 202 that extends between the strike face 108 and the crown 112. The inner surface 200 defines the chamfer plane 208 that is oriented at an angle θ relative to the loft plane. The angle θ in the illustrated embodiment is approximately 45 degrees, although in other or additional embodiments, the angle θ may be in the range of approximately 30 degrees and 60 degrees (e.g., approximately 31 degrees, approximately 32 degrees, approximately 33 degrees, approximately 34 degrees, approximately 35 degrees, approximately 36 degrees, approximately 37 degrees, approximately 38 degrees, approximately 39 degrees, approximately 40 degrees, approximately 41 degrees, approximately 42 degrees, approximately 43 degrees, approximately 44 degrees, approximately 45 degrees, approximately 46 degrees, approximately 47 degrees, approximately 48 degrees, approximately 49 degrees, approximately 50 degrees, approximately 51 degrees, approximately 52 degrees, approximately 53 degrees, approximately 54 degrees, approximately 55 degrees, approximately 56 degrees, approximately 57 degrees, approximately 58 degrees, or approximately 59 degrees). For example, in some embodiments, the angle θ may be in the range of approximately 30 degrees to 45 degrees, approximately 45 degrees to 60 degrees, approximately 30 degrees to 40 degrees, approximately 40 degrees to 50 degrees, or approximately 50 degrees to 60 degrees.

The chamfer 136 moves the hinge point 204 between the strike face 108 and the crown 112 towards the rear portion 128 and away from the strike face 108. The hinge point 204, (e.g., the plastic hinge) is spaced apart from the respective loft plane 164, by a distance measured in a direction perpendicular from the loft plane 164. The distance of the golf club head 100 with the chamfer 136 is greater than the distance of the conventional golf club head. In the illustrated embodiment, the distance is approximately 0.18 inches. However, in additional or alternative embodiments, the distance is a minimum distance ranging from approximately 0.10 inches (2.54 mm) to approximately 0.5 inches (12.7 mm). For example, the distance can be approximately 0.10 inches (2.54 mm), approximately 0.11 inches (2.79 mm), approximately 0.12 inches (3.05 mm), approximately 0.13 inches (3.3 mm), approximately 0.14 inches (3.56 mm), approximately 0.15 inches (3.81 mm), approximately 0.16 inches (4.06 mm), approximately 0.17 inches (4.32 mm), approximately 0.18 inches (4.57 mm), approximately 0.19 inches (4.83 mm), approximately 0.20 inches (5.08 mm), approximately 0.21 inches (5.33 mm), approximately 0.22 inches (5.59 mm), approximately 0.23 inches (5.84 mm), approximately 0.24 inches (6.10 mm), approximately 0.25 inches (6.35 mm), approximately 0.26 inches (6.60 mm), approximately 0.27 inches (6.86 mm), approximately 0.28 inches (7.11 mm), approximately 0.29 inches (7.37 mm), approximately 0.30 inches (7.62 mm), approximately 0.31 inches (7.87 mm), approximately 0.32 inches (8.12 mm), approximately 0.33 inches (8.38 mm), approximately 0.34 inches (8.64 mm), approximately 0.35 inches (8.89 mm), approximately 0.36 inches (9.14 mm), approximately 0.37 inches (9.40 mm), approximately 0.38 inches (9.65 mm), approximately 0.39 inches (9.91 mm), approximately 0.40 inches (10.2 mm), approximately 0.41 inches (10.4 mm), approximately 0.42 inches (10.7 mm), approximately 0.43 inches (10.9 mm), approximately 0.44 inches (11.2 mm), approximately 0.45 inches (11.4 mm), approximately 0.46 inches (11.7 mm), approximately 0.47 inches (11.9 mm), approximately 0.48 inches (12.2 mm), approximately 0.49 inches (12.4 mm), or approximately 0.50 inches (12.7 mm).

In some embodiments, the golf club head comprises a driver having a chamfer 136 with a width of between approximately 0.75 and approximately 4.50 inches, a length of between approximately 0.15 inches and approximately 0.25 inches, and a maximum thickness of between approximately 0.095 inches and approximately 0.150 inches, wherein the maximum thickness is measured between the inner surface 200 and the outer surface 202 of the chamfer 136. In these or other embodiments, a ratio of the maximum thickness to a thickness of the crown 112 measured adjacent to the chamfer 136 can be between approximately 1.15 and 3.00.

In some embodiments, the golf club head 100 comprises a fairway wood having a chamfer 136 with width of between approximately 0.75 and approximately 3.50 inches, a length of between approximately 0.05 inches and approximately 0.25 inches, and a maximum thickness of between approximately 0.025 inches and approximately 0.070 inches, wherein the maximum thickness is measured between the inner surface 200 and the outer surface 202 of the chamfer 136. In these or other embodiments, a ratio of the maximum thickness to a thickness of the crown 112 measured adjacent to the chamfer 136 can be between approximately 1.15 and 4.00.

The chamfer 136 results in a greater amount of internal energy transferred to the golf club head 100 during impact, such that a greater amount of internal energy of the golf club head 100 is transferred back to the ball. This is because the effect of the higher concentrations of stress at the hinge point 204 results in a greater bowing or a peak bending (e.g., movement in the direction of rear portion 128) of the crown 112 than that of the golf club head 100. The greater bowing of the crown 112 causes an uneven bowing effect with bowing of the sole 116. Stated another way, the chamfer 136 acts as a "plastic hinge" at the peak bending (e.g., the hinge point 204), promoting more localized deformation due to impact with the golf ball. The chamfer 136 separates spin influence from the CG, while still allowing for a high MOI of the golf control club head 100. As such, the chamfer 136 results in a lower spin due to dynamic face shearing and net loft during the ball impact. The dynamic face shearing counteracts the spin imparted on the ball, by bending away from the ball at the hinge point 204, therefore lowering the overall spin.

The chamfer 136 provides a spin reducing hinge. In other words, adding the chamfer 136 as described herein between the strike face 108 and the crown 112 changes the timing of the face response, leading to spin reductions of 100-400 rpm. The introduction of the chamfer 136 overcomes the need to move the CG forward, which lowers the MOI. The chamfer 136 allows for the CG to be closer to the rear portion and the MOI to remain high, which provides maximum forgiveness, while lowering the spin of the ball.

ii. Internal Radius Transition

In some embodiments, the one or more energy storage features can comprise an internal radius transition feature. In some embodiments, the golf club head 100 can comprise a cascading transition region, a tiered transition region, or an internal radius transition feature 140 instead of or in addition to the chamfer 136. The internal radius transition feature 140 extends from the strike face 108 to at least one of the crown 112, the heel region 120, the toe region 124, the sole 116, or the rear portion 128. In some embodiments, the golf club head 100 can comprise a single, continuous tiered transition region ring around a circumference of perimeter of the golf club head. For example, a tiered transition region ring from the strike face 108 to each of the crown 112, the toe region 124, the heel region 120, and the sole 116, both running from the toe region 124 to the heel region 120. In other embodiments, the golf club head 100 comprises a tiered transition region only at the crown 112 and/or at the sole 116 running from the toe region 124 to the heel region 120. In some embodiments, the golf club head 100 comprises a tiered transition region only at the toe region 124 and/or at the heel region 120 in either the crown 112, sole 116, or combination of the sole 116 and crown 112. In other examples, the tiered transition region is only located from the strike face 108 to the rear portion 128. In other embodiments, the golf club head 100 comprises separate or individual tiered transition regions from the strike face 108 to the toe region 124 of the crown 112, the heel region 120 of the crown 112, the toe region 124 of the sole 116, and/or the heel region 120 of the sole 116.

Figure 11:
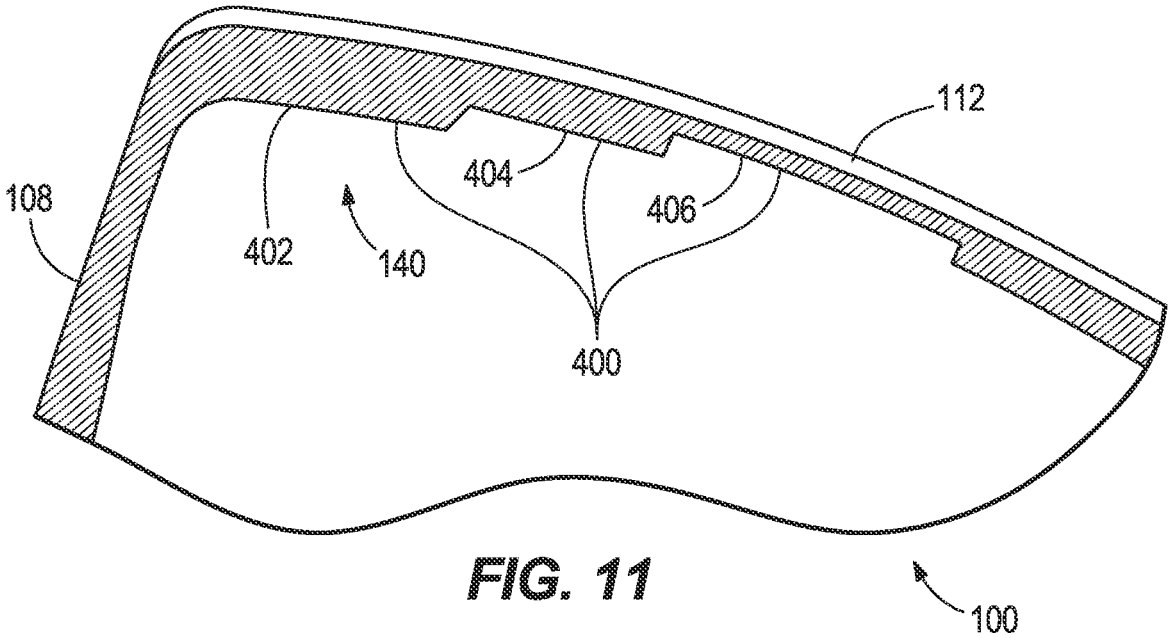
FIG. 11 illustrates an enlarged cross-sectional view of a crown internal radius transition feature of the golf club head of FIG. 1.
Figure 12:
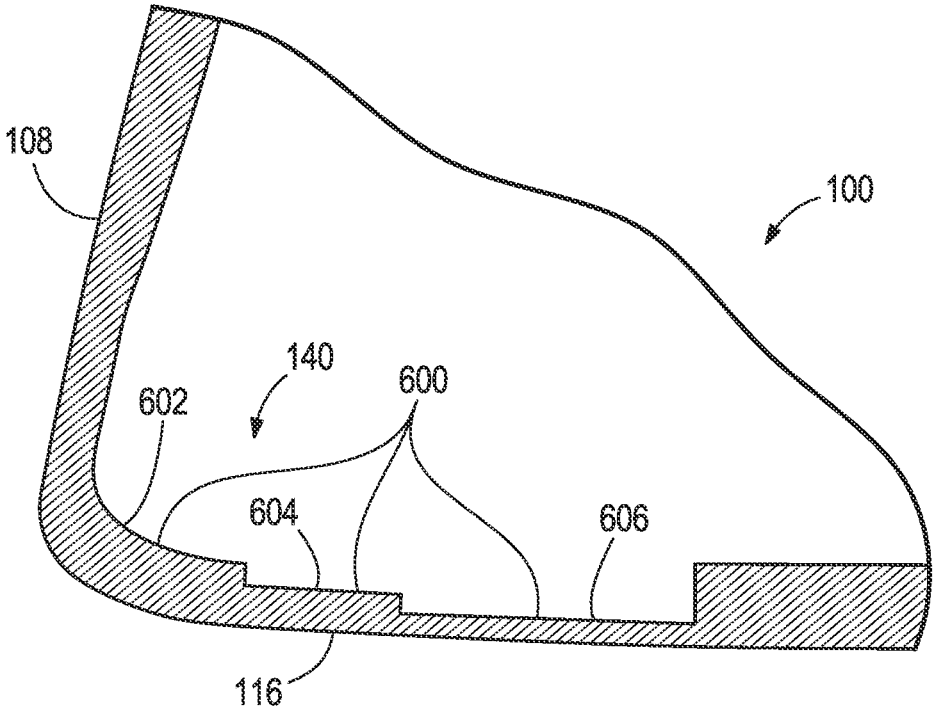
FIG. 12 illustrates an enlarged cross-sectional view of a sole internal radius transition feature of the golf club head of FIG. 1.

In one embodiment, FIGS. 4, 11, and 12 shows an internal radius transition feature 140 from strike face 108 to the front portion of the sole 116. The internal radius transition feature 140 can comprise a smooth transition, or the internal radius transition feature 140 can comprise a cascading sole of at least two tiers 400 or levels of thickness. For example, the internal radius transition feature 140 can comprise a cascading sole having 2, 3, 4, 5, 6, or 7 tiers 400. In some embodiments, the internal radius transition feature 140 can provide more bending of strike face 108. In some examples, the increase in bending or deflection of strike face 108 can allow approximately 1% to approximately 3% more internal energy, generated within the club head 100, from the increased deflection of strike face 108.

In many embodiments, internal radius transition feature 140 is not visible from the exterior of the golf club head 100. FIG. 11 also shows an internal radius transition feature 140 from strike face 108 to crown 112. In some embodiments, the internal radius transition 140 feature can comprise a smooth transition, while in other embodiments, the internal radius transition 140 can comprise at least two tiers 400 or levels of thickness. For example, the internal radius transition 140 can comprise 2, 3, 4, 5, 6, or 7 tiers 400 or levels of thickness.

In one embodiment, the internal radius transition feature 140 comprises a first tier 402 having a first thickness, and a second tier 404 having a second thickness. In many embodiments, the thickness of each tier is substantially constant. For example, the first thickness of first tier 402 can comprise a first substantially constant thickness, and the second thickness of second tier 404 can comprise a second substantially constant thickness. In other embodiments, first tier 402 can comprise a first slope, wherein the first thickness of first tier 402 is thicker closer to strike face 108 and thinner closer to a tier transition region. The tier transition region 408 can comprise a tier slope that is steeper than the first slope of first tier 402. The tier transition region 408 can be linearly sloped at an angle less than 90 degrees to transition from first tier 402 to second tier 404. In other embodiments, tier transition region can comprise an approximately 90-degree step, as shown in FIG. 12.

Figure 13:
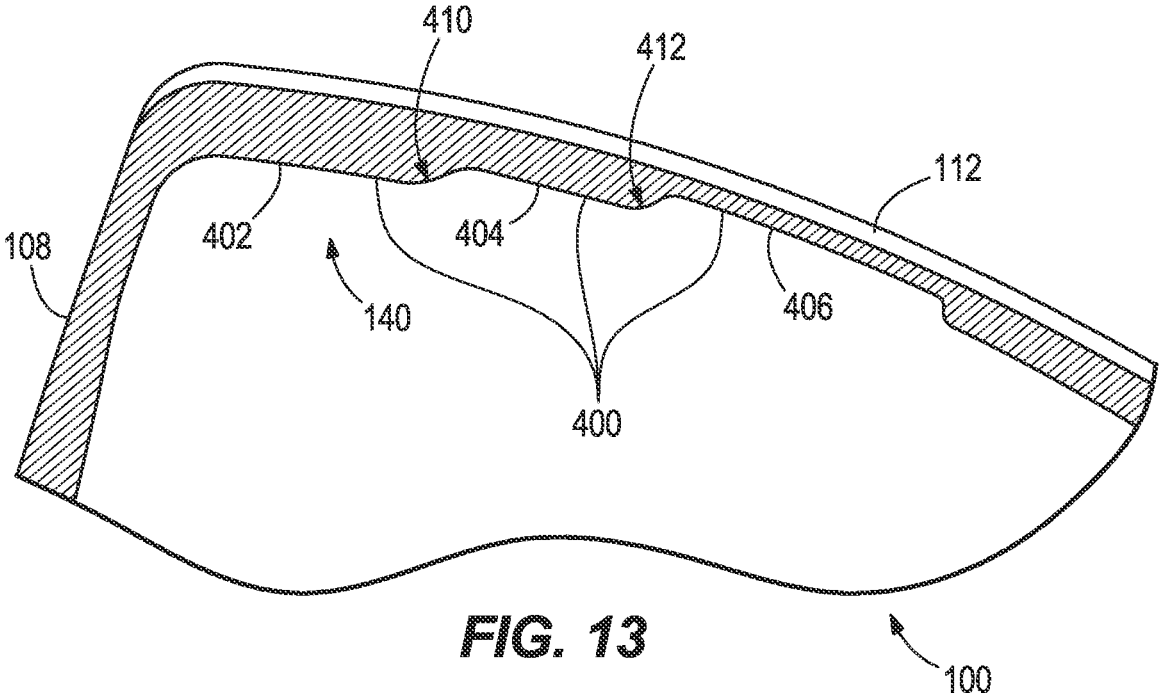
FIG. 13 illustrates an enlarged cross-sectional view of a crown internal radius transition feature of the golf club head of FIG. 1, according to an embodiment.
Figure 14:
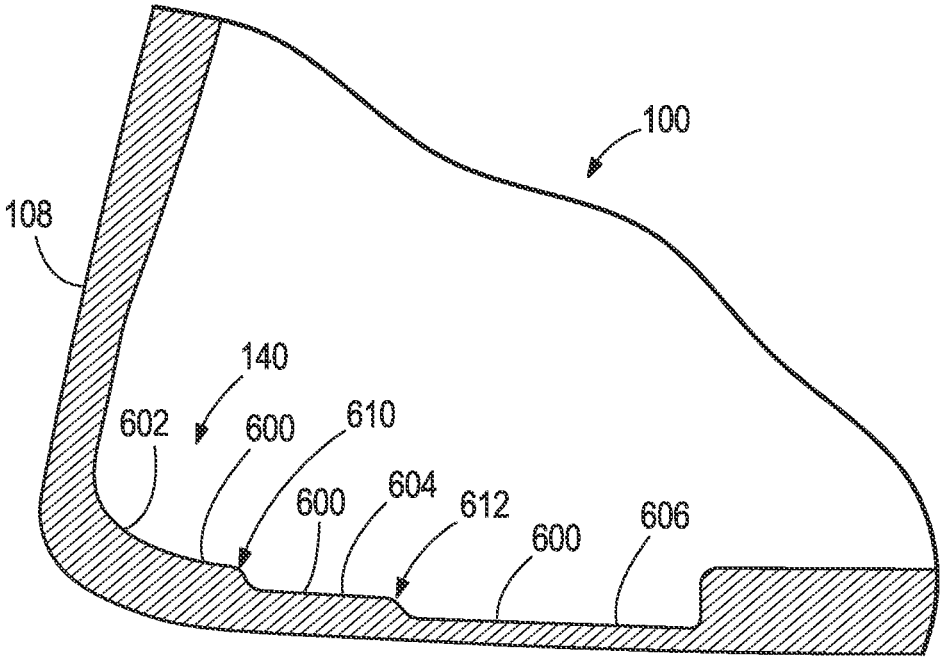
FIG. 14 illustrates an enlarged cross-sectional view of a sole internal radius transition feature of the golf club head of FIG. 1, according to an embodiment.
Figure 15:
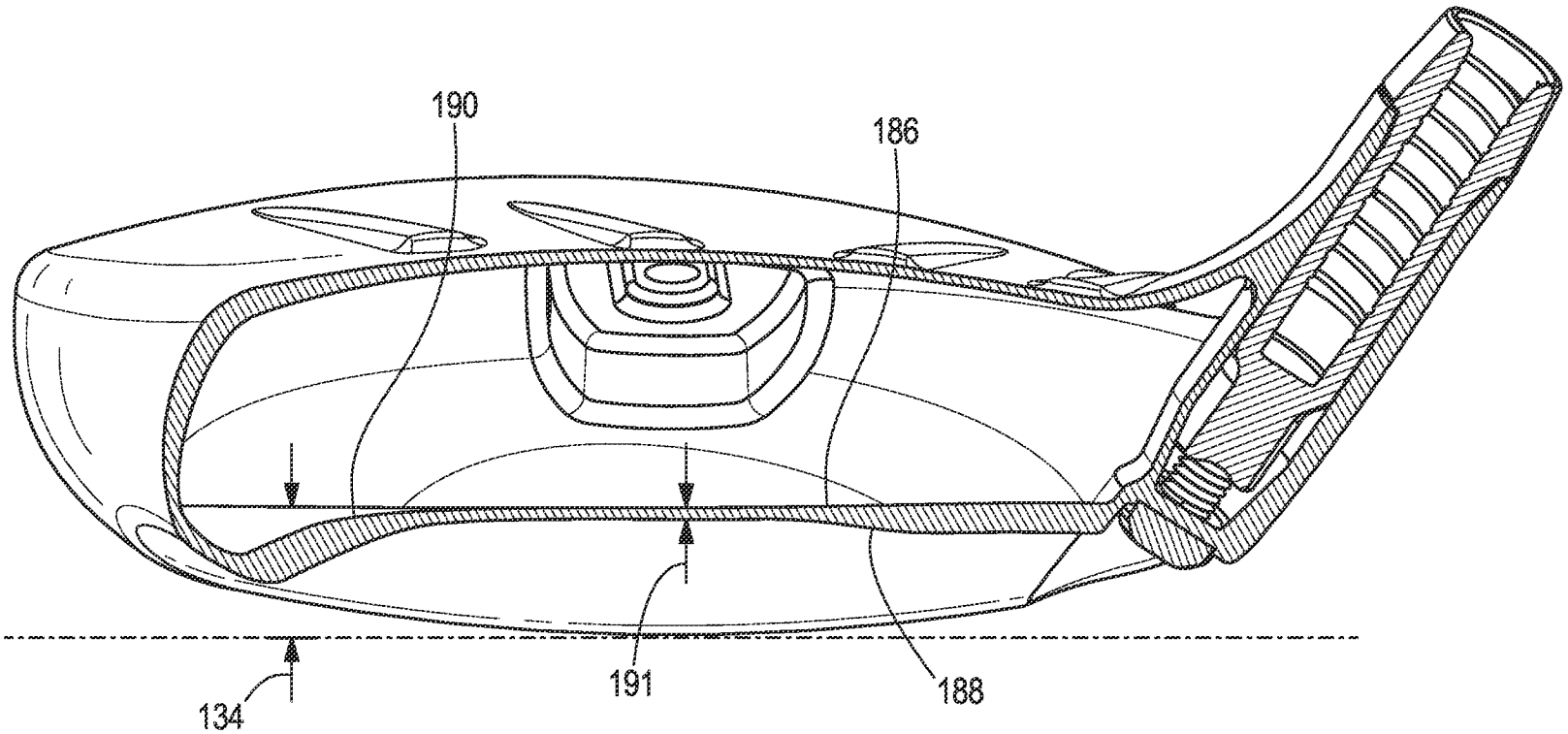
FIG. 15 illustrates a front cross-sectional view of the golf club head of FIG. 1, taken along line XV-XV of FIG. 1.

In some embodiments, such as those shown in FIGS. 13 and 14, each tiered transition can include a first arcuate surface 410, 610 and a second arcuate surface 412, 612. The first arcuate surface 410, 610 has a first radius of curvature and the second arcuate surface 412, 612 has a second radius of curvature. The first radius of curvature and the second radius of curvature of each tiered transition can be the same, or the first radius of curvature and the second radius of curvature of each tiered transition can be different. For example, the first radius of curvature of the first arcuate surface 410, 610 can be the same as the second radius of curvature of the first arcuate surface 410, 610, the first radius of curvature of the first arcuate surface 410, 610 can be less than the second radius of curvature of the first arcuate surface 410, 610, or the first radius of curvature of the first arcuate surface 410, 610 can be greater than the second radius of curvature of the first arcuate surface 410, 610. For further example, the first radius of curvature of the second arcuate surface 412, 612 can be the same as the second radius of curvature of the second arcuate surface 412, 612, the first radius of curvature of the second arcuate surface 412, 612 can be less than the second radius of curvature of the second arcuate surface 412, 612, or the first radius of curvature of the second arcuate surface 412, 612 can be greater than the second radius of curvature of the second arcuate surface 412, 612.

Further, each of the tiered transitions can have the same first radius of curvature or a different first radius of curvature, and each of the tiered transitions can have the same second radius of curvature or a different second radius of curvature. For example, the first radius of curvature of the first arcuate surface 410, 610 can be the same as the first radius of curvature of the second arcuate surface 412, 612, the first radius of curvature of the first arcuate surface 410, 610 can be less than the first radius of curvature of the second arcuate surface 412, 612, or the first radius of curvature of the first arcuate surface 410, 610 can be greater than the first radius of curvature of the second arcuate surface 412, 612. For further example, the second radius of curvature of the first arcuate surface can be the same as the second radius of curvature of the second arcuate surface 412, 612, the second radius of curvature of the first arcuate surface can be less than the second radius of curvature of the second arcuate surface 412, 612, or the second radius of curvature of the first arcuate surface can be greater than the second radius of curvature of the second arcuate surface 412, 612.

The internal radius transition features 140 (e.g. internal radius transition feature, tiered transitions, or cascading transition region) can change where a peak bending of a golf club head occurs. The internal radius transition feature 140 can create a "plastic hinge" at the peak bending, promoting more localized deformation due to impact with the golf ball. In many embodiments, the buckling process starts at the location of the peak bending and the golf club head 100 is optimized to stay just under the critical buckling threshold. The intentional plastic hinge allows the club to flex more in the crown 112 and sole 116 direction. Intentional plastic hinge allows control over exactly where and how much the crown 112 and sole 116 will flex by using the tiers 400.

In other embodiments, such as shown in FIGS. 11 and 12, the internal radius transition feature 140 can have 2, 3, 4, 5, 6, or 7 tiers 400, 600. A three-tier internal radius transition feature 140 can be similar to internal radius transition feature 140 (FIG. 11) and has a first tier 402, 602, a second tier 404, 604, and a third tier 506, 606. First tier 402, 602 can be similar to first tier 402 in FIG. 11, and second tier 404, 604. In many embodiments, a peak bending can occur further back from strike face 108 as more tiers 400, 600 are added to the internal radius transition feature 140.

In some embodiments, the first tier 402, 602, can directly abut the strike face, the second tier 404, 604, can directly abut the first tier, and the third tier 406, 606, can directly abut the second tier 404, 604. In some embodiments, a first tier transition region can directly abut the first tier 402, 602, a second tier 404, 604 can directly abut the first tier transition region, a second tier transition region can directly abut the second tier 404, 604, and a third tier 406, 606 can directly abut the second tier transition region.

In many embodiments, the first tier 402, 602, second tier 404, 604, and third tier 406, 606 can all comprise a thickness, wherein the thickness of each tier is measured between an internal surface 186 and an external surface 188, perpendicular to the tier. In many embodiments, the second tier 404, 604, is thicker than third tier 406, 606. In some embodiments of a driver-type golf club head, the third tier 406, 606 is approximately 0.010 inch to approximately 0.040 inch (0.102 cm) thick, or approximately 0.020 inch (0.051 cm) to approximately 0.030 inch (0.076 cm) thick. In some embodiments of a fairway wood-type golf club head, the third tier 406, 606 is approximately 0.015 inch (0.038 cm) to approximately 0.045 inch (0.114 cm) thick, or approximately 0.025 inch (0.064 cm) to approximately 0.035 inch (0.089 cm) thick. In some embodiments of a hybrid-type golf club head, the third tier 406, 606 is approximately 0.030 inch (0.076 cm) to approximately 0.060 inch (0.152 cm) thick, or approximately 0.040 inch (0.102 cm) to approximately 0.050 inch (0.127 cm) thick. In other embodiments of a fairway-type golf club head or a driver-type golf club head or a hybrid-type golf club head, the first tiers 402, 602, second tiers 404, 604, and third tiers 406, 606, can have thicknesses of approximately 0.02 inch (0.051 cm) to 0.80 inch (2.03 cm).

In some embodiments of a driver-type golf club head, first tier 402, 602, can be approximately 0.045 inch (0.114 cm) thick; second tier 404, 604, can be approximately 0.035 inch (0.089 cm) thick; and third tier 406, 606 can be approximately 0.025 inch (0.064 cm) thick. In some embodiments of a fairway wood-type golf club head, first tier 402, 602 can be approximately 0.051 inch (0.130 cm) thick; second tier 404, 604 can be approximately 0.039 inch (0.099 cm) thick; and third tier 606, 806 can be approximately 0.030 inch (0.076 cm) thick. In some embodiments of a hybrid-type golf club head, first tier 402, 602 can be approximately 0.067 inch (0.170 cm) thick; second tier 404, 604 can be approximately 0.054 inch (0.137 cm) thick; and third tier 406, 606 can be approximately 0.045 inch (0.114 cm) thick.

In many embodiments, the first tier 402, 602, second tier 404, 604, and third tier 406, 606 can all comprise a length, wherein the length of each tier is measured in a direction from the strike face 108 towards the rear portion 128 of the golf club 100. In some embodiments of a fairway wood-type golf club head or a driver-type golf club head or a hybrid-type golf club head, the first tiers 402, 602 can have lengths of approximately 0.05 inch (0.127 cm) to approximately 0.80 inch (2.03 cm); the second tiers 404, 604 can have lengths of approximately 0.03 inch (0.076 cm) to approximately 0.60 inch (1.52 cm); and the third tiers 406, 606 can have lengths of approximately 0.04 inch (0.102 cm) to approximately 0.70 inch (1.78 cm). In some embodiments of a fairway wood-type golf club head or a driver-type golf club head or a hybrid-type golf club head, the internal radius transition feature 140 can have a total length (summation of the first tier length, second tier length, and third tier length) of approximately 0.12 inches (0.305 cm) to approximately 2.10 inches (5.33 cm).

In some embodiments, the first tiers in FIGS. 11 and 12, respectively 402, 602, can have a first tier length that is approximately equal to a second tier length of second tiers 404, 604. In some embodiments, the length of the first tiers 402, 602 can have a first tier length that is longer than the length of second tiers 404 and 604. In other embodiments, the length of the first tiers 402, 602 can be shorter than the length of the second tiers 404 and 604. In other embodiments, the second tier length of second tiers 404, 604, can be approximately equal to a third tier length of third tiers 406, 606. In some embodiments, the second tier length of second tiers 404, 604, can be longer than the third tier length of third tiers 406, 606. In other embodiments, the second tier length of second tiers 404, 604, can be shorter than the third tier length of third tiers in 406, 606.

Using the internal radius transition feature 140, the stress of the golf club head can be distributed across a larger volume of material, thus lowering the localized peak stress. In many embodiments, the additional flex from crown 112 to sole 116 allows the strike face 108 to bend further based on the same loading. This additional flex can generate more stress and bending in the strike face 108 of the control club head 100 to create more spring energy. An increase in spring energy can be stored in the golf club head 100 due to an impact with the golf ball. In many embodiments, the additional spring energy will help to increase ball speed. In some embodiments, the internal radius transition feature 140 can create more overall bending in the golf club head 100, which also can lead to more ball speed. Higher ball speeds across the strike face 108 can result in better distance control. In some embodiments, the golf club head 100 with internal radius transition features 140 can store approximately 4% to approximately 6% more energy, which can then be returned to the golf ball.

Further, there is a greater dispersion of high stress over a greater area of sole 116 with an internal radius transition feature 140 than a sole without an internal radius transition feature. In many embodiments, a general curve of a sole 116 similar to uniform sole thickness can absorb greater particular concentrations of impact force from a golf ball in particular regions of the golf club head 100 but will not disperse the force over a larger area. The cascading structure (or tiers of varying thickness along the internal radium transition), such as an internal radius transition feature 140, however provides a technique to "package" the impact force from the golf ball over a larger area as the undulating or tier structure transfers higher stresses from one internal radium region of particular thickness to the next. In many embodiments, there is a bleeding, overflow, or pooling of the stress over internal radius transition feature. The greater dispersion of the greater stress force provides a greater recoiling force to the strike face 108. The pooling of the stress over internal radius transition feature 140 also can prevent all of the stress from collecting directly at the thinnest tier. In many embodiments, the tiered features can help distribute the stress along the sole 116 to prevent one large stress riser. Instead, there are multiple stress risers for a more even distribution of the stress. The stresses are extended along the internal radius transition feature 140, allowing the sole 116 to absorb more stress. The stress, however, decreases at the thickest portion of the sole 116 that, without the cascading sole, experiences the highest level of stress, and provides less spring back force to the strike face 108.

An embodiment of a golf club head 100 having an internal radius transition feature 140 was tested compared to a similar control club head devoid of a cascading sole. The club head 100 with the internal radius transition feature 140 showed an increase in ball speed of approximately 0.5-1.5 miles per hour (mph) (0.8-2.4 kilometers per hour, kph), or approximately 0.5-0.9%, compared to the control club head. The increase in ball speed for center impacts was approximately 0.5-1.0 mph (0.8-1.6 kph), and the increase in ball speed for off-center impacts was approximately 1-1.5 mph (1.6-2.4 kph). The club head 100 with the internal radius transition feature 140 further showed an increase in launch angle of approximately 0.1-0.3 degrees, a decrease in spin of approximately 275-315 revolutions per minute (rpm), and an increase in carry distance of approximately 3-6 yards (2.7-5.5 meters) compared to the control club head.

iii. Channel

In some embodiments, the one or more energy storage features can comprise a channel. Referring to FIGS. 1-5, the golf club head 100 can comprise a channel 132 instead of or in addition to the chamfer 126 and/or the internal radius transition feature 140. The channel 132 protrudes inward, into the hollow body, from a portion of the crown 112 or the sole 116. In many embodiments, the channel 132 is located on the sole 116, offset from the strike face 108 and extending from near the heel region 120 to near the toe region 124, in a direction substantially parallel to the strike face 108. In other, embodiments, the channel 132 can be located on the crown 112.

Figure 5:
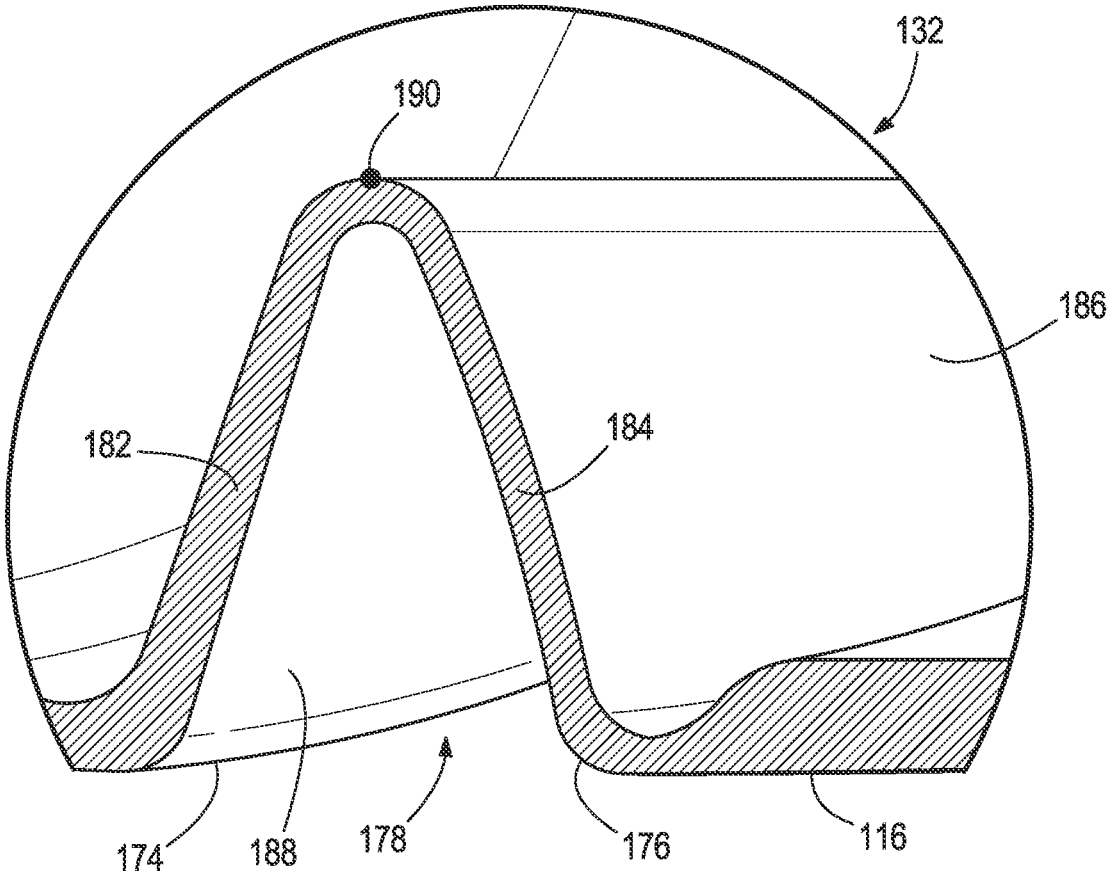
FIG. 5 illustrates an enlarged cross-sectional view of the channel of the golf club head of FIG. 1.

FIGS. 1, 4, and 5 illustrate an embodiment of the golf club head 100 having a channel 132 comprising a generally triangular shape with a rounded top. The channel 132 comprises a front edge 174 adjacent to the sole 116, near the strike face 108. The channel 132 comprises a rear edge 176 adjacent to the sole 116 and offset from the front edge 174 in a direction toward the rear portion 128 of the club head. In the illustrated embodiment, the rear edge 176 is approximately parallel to the front edge 174.

The channel 132 comprises a main portion 178 extending inward from the sole 116 between the front edge 174 and the rear edge 176. The channel 132 comprises an apex 190 positioned along the tallest portion of the channel 132. The apex 190 extends from the heel region 120 to the toe region 124. The channel 132 further comprises a front wall 182, spanning from the front edge 174 to the apex 190. Furthermore, the channel 132 comprises a rear wall 184, spanning from the rear edge 176 to the apex 190. The apex 190 separates the front wall 182 from the rear wall 184.

The rear wall 184 of the channel 132 further comprises a curvature. The curvature of the rear wall 184 is concave in relation to the strike face 108 and/or front wall 182 thus making the rear wall 184 cambered. The camber of the rear wall 184 allows a leading edge 180 of the sole 116 to more easily move down and back when striking a golf ball, compared to a channel with a flat rear wall. Specifically, the curvature of the rear wall 184 is oriented in such a way, that the camber promotes the flexing of the channel 132 when striking a golf ball, thus translating the force of the impact into spring potential energy, as opposed to a flat rear wall which would absorb most of the impact force. The flat rear wall of a channel will merely absorb and release some of the compressive energy of the channel, as the channel compresses during impact, and expands following impact. This expansion is mostly caused by the material properties of the club head, rather than the geometry of the channel with a flat rear wall. The geometry of the channel 132 with a cambered rear wall 184, directs the compressive force down and away from the strike face 108, allowing the strike face 108 to flex, thus creating an optimal spring like effect across the channel 132, that is then transferred to the golf ball.

The channel 132 results in a greater amount of internal energy generated by the golf club head 100 during impact, such that a greater amount of internal energy of the golf club head 100 is transferred back to the ball. In one embodiment, the front wall 182 of the channel 132, comprises a thickness that is thicker near the sole 116 than the apex 190, allowing the stress of impact to be distributed from the leading edge 180 to the channel 132, without compromising the structural integrity of the leading edge 180 or sole. Furthermore, the channel 132 allows the club head 100 to compress near the sole 116 when impacting a golf ball, thus creating spring potential energy. This potential energy is transferred to the ball, resulting in higher ball speeds. Further, the bending of the sole 116 down and away lowers the spin of the ball, as the strike face 108 is slightly delofted, due to the bending caused by the channel 132. Lowering the spin of the ball, leads to improvements in the overall distance the ball travels. The ability of the leading edge 180 of the sole 116 to move down and back during impact, can reduce the spin on the golf ball and store more energy to increase the ball speed, thus leading to longer straighter shots.

The camber of the rear wall 184 comprises a radius of curvature. In many embodiments, the radius of curvature of the camber of the rear wall 184 can range between 0.5 inches and 5.0 inches. In some embodiments, the radius of curvature of the camber of the rear wall 184 can range between 0.5 inches-1.0 inches, 1.0 inches-1.5 inches, 1.5 inches-2.0 inches, 2.0 inches-2.5 inches, 2.5 inches-3.0 inches, 3.0 inches-3.5 inches, 3.5 inches-4.0 inches, 4.0 inches-4.5 inches, or 4.5 inches-5.0 inches. In one embodiment, the radius of curvature of the camber of the rear wall 184 can range between 2.0 inches and 2.5 inches.

The front edge 174 of the channel 132 is positioned a distance from the strike face 108. The distance of the front edge 174 from the strike face 108 is measured perpendicular to the strike face 108 to the front edge 174 of the channel 132. In most embodiments, the front edge 174 distance from the strike face 108 can range between 0.15 inches and 0.60 inches. In some embodiments, the front edge 174 distance from the strike face 108 can range between 0.15 inches-0.20 inches, 0.20 inches-0.25 inches, 0.25 inches-0.30 inches, 0.30 inches-0.35 inches, 0.35 inches-0.40 inches, 0.40 inches-0.45 inches, 0.45 inches-0.50 inches, 0.50 inches-0.55 inches, or 0.55 inches-0.60 inches. In other embodiments, the front edge 174 distance from the strike face 108 can range between 0.15 inch, 0.16 inch, 0.17 inch, 0.18 inch, 0.19 inch, 0.20 inch, 0.21 inch, 0.22 inch, 0.23 inch, 0.24 inch, 0.25 inch, 0.26 inch, 0.27 inch, 0.28 inch, 0.29 inch, 0.30 inch, 0.31 inch, 0.32 inch, 0.33 inch, 0.34 inch, 0.35 inch, 0.36 inch, 0.37 inch, 0.38 inch, 0.39 inch, 0.40 inch, 0.41 inch, 0.42 inch, 0.43 inch, 0.44 inch, 0.48 inch, 0.49 inch, 0.50 inch, 0.51 inch, 0.52 inch, 0.53 inch, 0.54 inch, 0.55 inch, 0.56 inch, 0.57 inch, 0.58 inch, 0.59 inch, or 0.60 inch. In one embodiment, the front edge 174 distance from the strike face 108 can range between 0.20 inches and 0.25 inches.

The channel 132 comprises a length, extending from near the heel region 120 to near the toe region 124 of the club head 100. In most embodiments, the length of the channel 132 can range between 0.5 inches and 5.0 inches. In some embodiments, the length of the front edge 174 of the channel 132 can range between 0.5 inches-1.0 inches, 1.0 inches-1.5 inches, 1.5 inches-2.0 inches, 2.0 inches-2.5 inches, 2.5 inches-3.0 inches, 3.0 inches-3.5 inches, 3.5 inches-4.0 inches, 4.0 inches-4.5 inches, or 4.5 inches-5.0 inches. In one embodiment, the length of the front edge 174 of the channel 132 can range between 3.5 inches and 4.0 inches.

The channel 132 comprises a width, measured from the front edge 174 to the rear edge 176. In some embodiments, the channel 132 can have a constant width across the channel 132 in a heel to toe direction. In other embodiments, the channel 132 can have a non-constant width across the channel 132 in a heel to toe direction. In many embodiments, the width of the channel 132 can range in between 0.10 and 0.80 inches. In other embodiments, the width of the channel 132 can range between 0.10 inches-0.15 inches, 0.15 inches-0.20 inches, 0.20 inches-0.25 inches, 0.25 inches-0.30 inches, 0.30 inches-0.35 inches, 0.35 inches-0.40 inches, 0.40 inches-0.45 inches, 0.45 inches-0.50 inches, 0.50 inches-0.55 inches, 0.55 inches-0.60 inches, 0.60 inches-0.65 inches, 0.65 inches-0.70 inches, 0.70 inches-0.75 inches, or 0.75 inches-0.80 inches. In one embodiment, the width of the channel 132 can range between 0.35 inches and 0.40 inches.

The channel 132 comprises a height 134. The height 134 of the channel 132 is measured perpendicular from ground plane 168 to the apex 190. In many embodiments, the height 134 of the channel 132 is constant from the heel to toe, however the height 134 of the channel 132 can vary from heel to toe. In most embodiments, the height 134 of the channel 132 can range between 0.15 inches and 0.90 inches. In some embodiments, the height 134 of the channel 132 can range from 0.15 inches-0.20 inches, 0.20 inches-0.25 inches, 0.25 inches-0.30 inches, 0.30 inches-0.35 inches, 0.35 inches-0.40 inches, 0.40 inches-0.45 inches, 0.45 inches-0.50 inches, 0.50 inches-0.55 inches, 0.55 inches-0.60 inches, 0.60 inches-0.65 inches, 0.65 inches-0.70 inches, 0.70 inches-0.75 inches, 0.75 inches-0.80 inches, 0.80 inches-0.85 inches, or 0.85 inches-0.90 inches. In one embodiment, the height 134 of the channel 132 can range between 0.45 inches and 0.50 inches.

The front wall 182 of the channel 132 comprises a front wall thickness. The thickness of the front wall 182 is measured from an internal surface 186 of the channel 132 at the front wall 182 to an external surface 188 of the channel 132 at the front wall 182. In many embodiments, the thickness of the front wall 182 can taper from near the front edge 174 toward the apex 190 such that the front wall 182 thickness is larger near the front edge 174 of the channel 132 and smaller near the apex 190. In some embodiments, the tapering of the front wall 182 can be a linear transition from the front edge 174 to the apex 190, while in other embodiments the tapering of the front wall 182 can be a non-linear transition (e.g., step, parabolic). In some embodiments, the thickness of the front wall 182 can be constant from the front edge 174 to the apex 190. In many embodiments, the thickness of the front wall 182 can range between 0.015 inches and 0.080 inches. In some embodiments, the thickness of the front wall 182 can range from 0.015 inches-0.020 inches, 0.020 inches-0.025 inches, 0.025 inches-0.030 inches, 0.030 inches-0.035 inches, 0.035 inches-0.040 inches, 0.040 inches-0.045 inches, 0.045 inches-0.050 inches, 0.050 inches-0.055 inches, 0.060 inches-0.065 inches, 0.065 inches-0.070 inches, 0.070 inches-0.075 inches, or 0.075 inches-0.080 inches. In one embodiment, the thickness of the front wall 182 nearest the apex 190 can range between 0.035 inches and 0.040 inches, and the thickness of the front wall 182 nearest the ground plane 168 can range between 0.055 inches and 0.060 inches.

An apex 190 of the channel 132 is positioned at the junction between the rear wall 184 and the front wall 182 of the channel 132. The apex 190 of the channel 132 comprises an apex thickness 191. The apex thickness 191 is measured from an internal surface 186 of the channel 132 at the apex 190 to an external surface 188 of the channel 132 at the apex 190. In some embodiments, the thickness 191 of the apex 190 can vary across the length of the channel 132, while in other embodiments, the thickness 191 of the apex 190 can be constant across the length of the channel 132. In many embodiments, the thickness 191 of the apex 190 can range between 0.015 inches and 0.080 inches. In some embodiments, the thickness 191 of the apex 190 can range from 0.015 inches-0.020 inches, 0.020 inches-0.025 inches, 0.025 inches-0.030 inches, 0.030 inches-0.035 inches, 0.035 inches-0.040 inches, 0.040 inches-0.045 inches, 0.045 inches-0.050 inches, 0.050 inches-0.055 inches, 0.060 inches-0.065 inches, 0.065 inches-0.070 inches, 0.070 inches-0.075 inches, or 0.075 inches-0.080 inches. In one embodiment, the apex thickness 191 can range between 0.035 inches and 0.040 inches. In another embodiment, the apex thickness 191 can be thicker nearer to the toe region 124 and heel region 120, and range between 0.035 inches and 0.070 inches.

The rear wall 184 of the channel 132 comprises a thickness. The thickness of the rear wall 132 is measured from an internal surface 186 of the channel 132 at the rear wall 184 to an external surface 188 of the channel 132 at the rear wall 184. In many embodiments, the thickness of the rear wall 184 can be constant from the ground plane 168 to the apex 190. In some embodiments, the thickness of the rear wall 184 can taper from the ground plane 168 to the apex 190. In some embodiments, the tapering of the rear wall 184 can be a linear transition from the ground plane 168 to the apex 190, while in other embodiments the tapering of the rear wall 184 can be a non-linear transition (e.g., step, parabolic). In many embodiments, the thickness of the rear wall 184 can range between 0.015 inches and 0.080 inches. In some embodiments, the thickness of the rear wall 184 can range from 0.015 inches-0.020 inches, 0.020 inches-0.025 inches, 0.025 inches-0.030 inches, 0.030 inches-0.035 inches, 0.035 inches-0.040 inches, 0.040 inches-0.045 inches, 0.045 inches-0.050 inches, 0.050 inches-0.055 inches, 0.060 inches-0.065 inches, 0.065 inches-0.070 inches, 0.070 inches-0.075 inches, or 0.075 inches-0.080 inches. In one embodiment, the thickness of the rear wall 184 can range between 0.035 inches and 0.040 inches.

a. S-Channel

Figure 6:
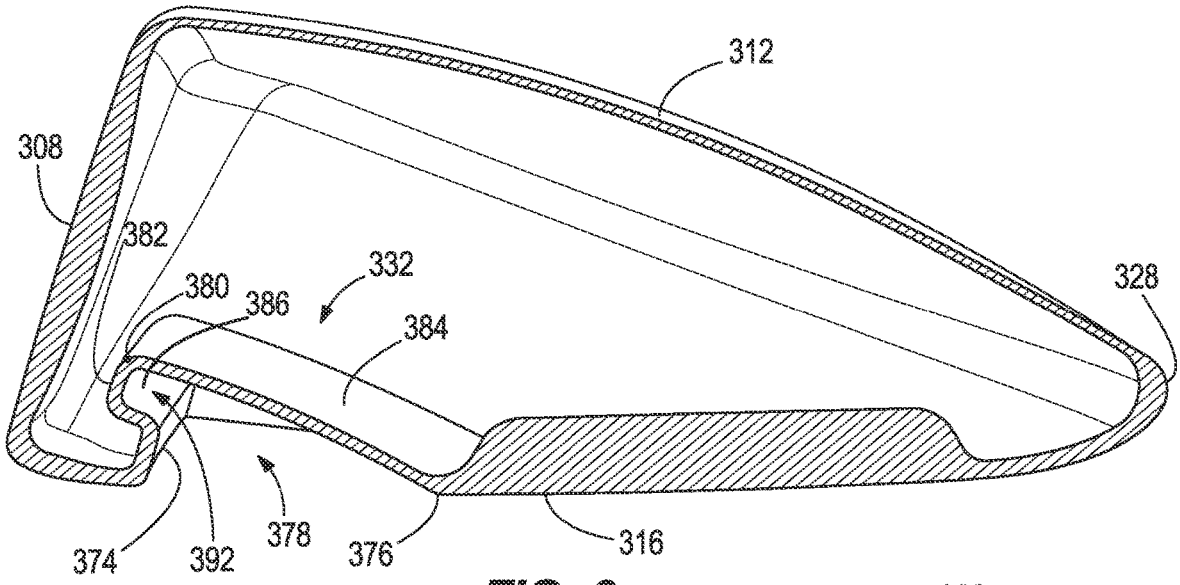
FIG. 6 illustrates an alternate embodiment of a golf club head comprising a sole channel.
Figure 7:
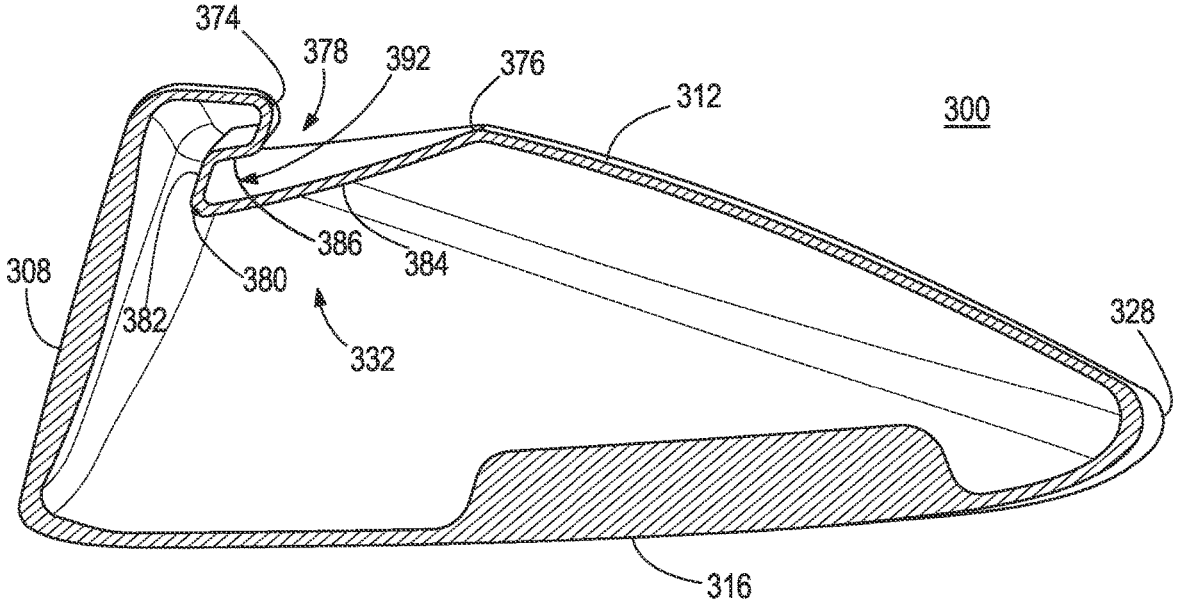
FIG. 7 illustrates an alternate embodiment of a golf club head comprising a crown channel.

FIGS. 6 and 7, illustrate another embodiment of a golf club head 300 having a channel 332. Club head 300 can comprise similar features as club head 100, with similar numbers describing like features. The channel 332 of the club head 300 can be similar to channel 132, except the front wall 382 of the channel 332 comprises an inset portion 392.

The front wall 382 of the channel 332 comprises an S-shape. The channel 332 protrudes inward, into the hollow body, from a portion of the sole 316 or crown 312. The channel 332 is positioned on the sole 316, spanning approximately parallel to the strike face 308 of the golf club head 300. The channel 332 comprises a front edge 374 adjacent to the sole 316. The channel 332 comprises a rear edge 376 adjacent to the sole 316, and approximately parallel to the front edge 374. The channel 332 comprises a main portion 378 extending inward from the sole 316 or crown 312 between the front edge 374 and the rear edge 376. The front wall 382 of the channel 332 comprises an inset portion 392 extending from the main portion 378 of the channel 332 toward the strike face 308. The channel 332 further comprises a front wall 382 and a rear wall 384. The front wall 382 extends from the front edge 374 to the apex 380. The front wall 382 is approximately parallel to the strike face 308. The rear wall 384 extends from the apex 380 to the rear edge 376 of the channel 332. Accordingly, the front wall 382 and rear wall 384 are separated by the apex 380 of the channel 332. The inset portion 392 comprises a bottom surface 386 that is approximately perpendicular to the loft plane 164 and the front wall 382, thus creating the "S-shape." This "S-shape" the channel 332, with a cambered rear wall 384, directs the compressive force down and away from the strike face 308, allowing the strike face 308 to flex, thus creating an optimal spring like effect across the channel 332, that is then transferred to the golf ball.

In many embodiments, the inset portion 392 of the channel 332 includes a height and a depth. In the illustrated embodiment, the height of the inset portion 392, measured parallel to the loft plane 364, remains constant from the heel region 320 to the toe region 324 of the club head 300. In the illustrated embodiment, the height of the channel 332 can vary from near the strike face 308 to near the rear portion 328 of the club head 300. For example, in the illustrated embodiments (FIGS. 6 and 7), the height of the channel 332 increases from near the strike face 308 to near the rear portion 328 of the club head 300. In other embodiments, the height of the channel 392 can vary according to any profile from near the strike face 308 to near the rear portion 328 of the club head 300.

Further, the height of the inset portion 392 can increase or decrease according to any profile from the heel region 320 to the toe region 324 of the club head 300. For example, the height of the inset the portion 392 can increase from the heel region 320 to the toe region 324 of club head 300. For further example, the height the of inset portion 392 can decrease from the heel region 320 to the toe region 324 of club head 300. For further example, the height of the inset portion 392 can increase moving from the centerpoint 344 of the club head 300 toward the heel region 320 and the toe region 324. For further example, the height of the inset portion 392 can decrease moving from the centerpoint 344 of the club head 300 toward the heel region 320 and the toe region 324.

The inset portion 392 increases strike face 308 deflection on impact with a golf ball, compared to a club head having a channel without an inset portion. Further, the inset portion 392 distributes stresses to a greater extent on impact with a golf ball compared to a club head having a channel without an inset portion. In many embodiments, greater dispersion of stresses in the golf club head 300 due to the ability of the inset portion 392 to prevent stress risers from occurring at the front edge 374 or rear edge 376 of the channel 332.

In many embodiments, positioning at least a portion of the front edge 374 of the channel 332 in close proximity to the strike face 308 can increase the internal energy stored by the club head 300 during impact, thereby increasing the energy transfer to a golf ball, compared to a similar club head having a channel with a front edge positioned farther from the strike face. Increasing the energy transfer to a golf ball can result in increased ball speed and travel distance.

The rear surface 384 of the channel 332 further comprises a curvature. The rear surface 384 is concave in relation to the strike face 308 and/or front wall 382, thus making the rear surface 384 cambered. The camber of the rear wall 384 allows the entire channel 332 more easily move down and back when striking a golf ball, compared to a channel with a flat rear wall. Specifically, the curvature of the rear wall 384 is oriented in such a way, that the camber promotes the flexing of the channel 332 when striking a golf ball, thus translating the force of the impact into spring potential energy, as opposed to a flat rear wall which would absorb most of the impact force. The ability of the channel 332 to transfer the compressive force of striking a golf ball down and back during impact, and the ability of the inset portion 392 to increase the face deflection, can dramatically reduce the spin on the golf ball and store more energy to increase the ball speed, thus leading to longer straighter shots.

b. Z-Channel

Figure 8:
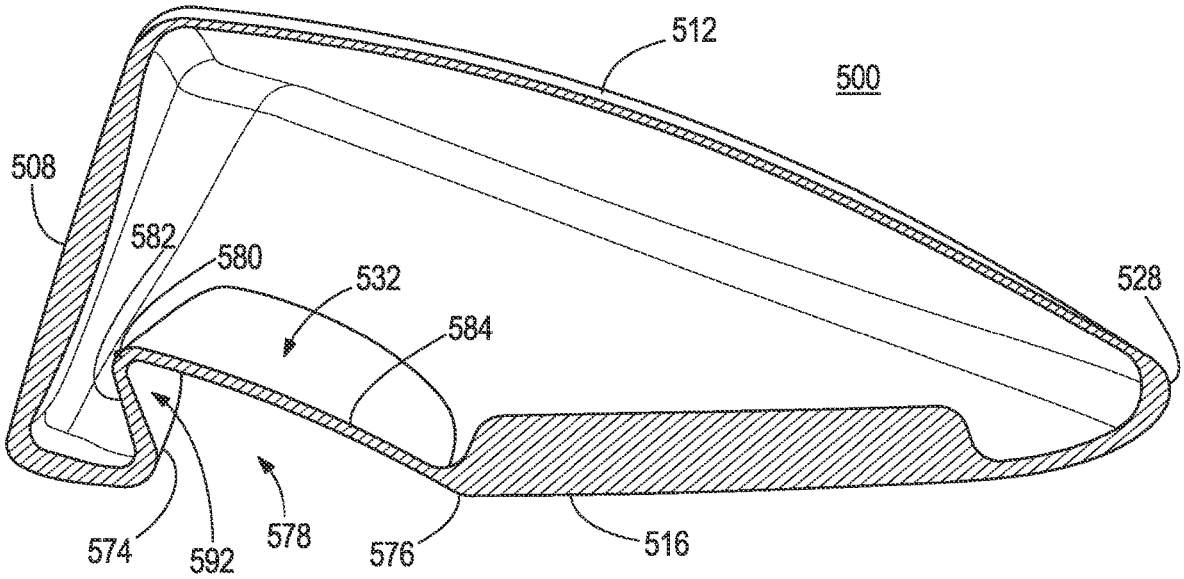
FIG. 8 illustrates an alternate embodiment of a golf club head comprising a sole channel.

FIG. 8 illustrates another embodiment of a golf club head 500 having a channel 532. Club head 500 can comprise similar features as club head 100, with similar numbers describing like features. The channel 532 of the club head 500 can be similar to channel 132, except the front wall 582 of the channel 532 comprises an inset portion 592.

The front wall 582 of the channel 500 comprises a Z-shape. The channel 532 protrudes inward, into the hollow body, from a portion of the sole 516 or crown 512. The channel 532 is positioned on the sole 516, spanning approximately parallel to the strike face 508 of the golf club head 500. The channel 532 comprises a front edge 574 adjacent to the sole 516. The channel 532 comprises a rear edge 576 adjacent to the sole 516, and approximately parallel to the front edge 574. The channel 532 comprises a main portion 578 extending inward from the sole 516 or crown 512 between the front edge 574 and the rear edge 576. The front wall 582 of the channel 532 comprises an inset portion 592 extending from the main portion 578 of the channel 532 toward the strike face 508. The channel 532 further comprises a front wall 582 and a rear wall 584. The front wall 582 extends from the front edge 574 to the apex 580. The front wall 582 is approximately parallel to the strike face 508. The rear wall 584 extends from the apex 580 to the rear edge 576 of the channel 532. Accordingly, the front wall 582 and rear wall 584 are separated by the apex 580 of the channel 532. The front wall 582 and inset portion 592 create approximately 45 degree angle with the ground plane 168, creating the "Z-shape". This "Z-shape" the channel 532, with a cambered rear wall 584, directs the compressive force down and away from the strike face 508, allowing the strike face 508 to flex, thus creating an optimal spring like effect across the channel 532, that is then transferred to the golf ball.

In many embodiments, the inset portion 592 of the channel 532 includes a height and a depth. In the illustrated embodiment, the height of the inset portion 592, measured parallel to the loft plane 564, remains constant from the heel region 520 to the toe region 524 of the club head 500. In the illustrated embodiment, the height of the channel 532 can vary from near the strike face 508 to near the rear portion 528 of the club head 500. For example, in the illustrated embodiment (FIG. 8), the height of the channel 532 increases from near the strike face 508 to near the rear portion 528 of the club head 500. In other embodiments, the height of the channel 532 can vary according to any profile from near the strike face 508 to near the rear portion 528 of the club head 500.

Further, the height of the inset portion 592 can increase or decrease according to any profile from the heel region 520 to the toe region 524 of the club head 500. For example, the height of the inset portion 592 can increase from the heel region 520 to the toe region 524 of club head 500. For further example, the height of the inset portion 592 can decrease from the heel region 520 to the toe region 524 of club head 500. For further example, the height of the inset portion 592 can increase moving from the centerpoint 544 of the club head 500 toward the heel region 520 and the toe region 524. For further example, the height of the inset portion 592 can decrease moving from the centerpoint 544 of the club head 500 toward the heel region 520 and the toe region 524.

The inset portion 592 increases strike face 508 deflection on impact with a golf ball, compared to a club head having a channel without an inset portion. Further, the inset portion 592 distributes stresses to a greater extent on impact with a golf ball compared to a club head having a channel without an inset portion. In many embodiments, greater dispersion of stresses in the golf club head 500 due to the ability of the inset portion 592 to prevent stress risers from occurring at the front edge 574 or rear edge 576 of the channel 532.

In many embodiments, positioning at least a portion of the front edge 574 of the channel 532 in close proximity to the strike face 508 can increase the internal energy stored by the club head during impact, thereby increasing the energy transfer to a golf ball, compared to a similar club head having a channel with a front edge positioned farther from the strike face. Increasing the energy transfer to a golf ball can result in increased ball speed and travel distance.

The rear wall 584 of the channel 532 further comprises a curvature. The rear wall 584 is concave in relation to the strike face 508 and/or front wall 582, thus making the rear wall 584 cambered. The camber of the rear wall 584 allows the entire channel 532 more easily move down and back when striking a golf ball, compared to a channel with a flat rear surface. Specifically, the curvature of the rear wall 584 is oriented in such a way, that the camber promotes the flexing of the channel 532 when striking a golf ball, thus translating the force of the impact into spring potential energy, as opposed to a flat rear wall which would absorb most of the impact force. The ability of the channel 532 to transfer the compressive force of striking a golf ball down and back during impact, and the ability of the inset portion 595 to increase the face deflection, can dramatically reduce the spin on the golf ball and store more energy to increase the ball speed, thus leading to longer straighter shots.

iv. Weight Member

In some embodiment, the body 104 of the golf club head 100 can further comprise a weight member 126. Referring to FIGS. 1 and 4, the weight member 126 is located on a portion of the sole of the golf club head. In some embodiments, the weight member 126 can be located on another portion of the golf club head 100, such as the rear portion 128 or the crown 112. In some embodiments, the weight member 126 can be permanently attached by adhesion, epoxy, welding, or another form of permanent attachment. In other embodiments, the weight member 126 can be removably attached by way of mechanical fastener, press-fit, or another form of removable attachment.

The weight member 126 provides a discretional mass positioning to improve the MOI and CG of the golf control club head 00. The increased MOI leads to increased directional forgiveness of the club head 100 for off centered hits, thus improving the overall performance of the golf club head 100. The positioning of the weight member 126, in junction with the channel 132, chamfer 136, and internal radius transition feature 140 can combine to form a high performing golf club head with a reduced spin, improved ball speed, and shot distance.

v. Method of Manufacture

Various embodiments of golf club heads with energy store features include a method for manufacturing a golf club head 100. The method of manufacture comprises providing a block of material. The body 104 comprises a strike face 108, a heel region 120, a toe region 124 opposite the heel region 120, a sole 116, and a crown 112. In some embodiments, the body 104 further comprises a rear portion extending between the crown 112 and sole 116. The method of manufacture further comprises providing any one or combination of the following: a channel 132 in a portion of a crown 112 or a sole 116, a chamfer 136 spanning between the strike face 108 and the crown 112, and an internal radius transition feature 140 from the strike face 108 to at least one of the sole 116 or the crown 112. In one embodiment, the channel 132, chamfer 136, and internal radius transition feature 140 can be provided simultaneously with each other such as casting the body 104 of the club head 100. In other embodiments, the channel 132, chamfer 136, and internal radius transition feature 140 can be provided separately through machining or milling, and joined together through epoxy, welding, swedging, press-fitting, or any other suitable method of j oining.

EXAMPLES

Example 1—Golf Club Head with Channel and Chamfer

An exemplary fairway wood type golf club head comprising a chamfer and a channel with a cambered rear wall (hereafter "the exemplary club head") experienced 13-19% greater deflection on impact with a golf ball, compared to a similar club head having a chamfer and a channel with a straight rear wall (hereafter "the control club head").

The deflection test measured the deflection of the exemplary and control club heads during impact with a golf ball, wherein the golf club heads were traveling at 115 mph. The test measured deflection at three locations, including: (1) deflection of the leading edge on the sole, (2) the deflection of the front edge of the channel, and (3) the deflection of the channel at the apex of the channel.

TABLE 1

| Location | Control Club Head: Deflection (inches) | Exemplary Club Head: Deflection (inches) | Delta (inches) | Percent change |
|---|---|---|---|---|
| Leading Edge | 0.038 | 0.047 | 0.009 | 19.15% |
| Front Edge of Channel | 0.041 | 0.049 | 0.008 | 16.33% |
| Channel Apex | 0.013 | 0.015 | 0.002 | 13.33% |

Referring to Table 1 above, upon impact with a golf ball, the exemplary club head deflected 0.038 inches at the leading edge of the sole, 0.041 inches between the strike face and the front wall of the channel, and 0.013 inches at the channel apex. Upon impact with a golf ball, the control club head deflected 0.047 inches at the leading edge, 0.049 inches between the strike face and the front wall of the channel, and 0.015 inches at the channel apex. The exemplary club head, comprising a cambered rear wall, increases deflection at the leading edge by 19.15% over control club head, comprising a flat rear wall. Further, the exemplary club head increases deflection between the strike face and the front wall of the channel by 16.33% over the control club head. Furthermore, the exemplary club head increases deflection at the channel apex by 13.33% over the control club head.

The curvature of the cambered rear wall of the exemplary club head allows the golf club head to bend and rotate more near the channel than a channel with a flat rear wall. The deflection of a golf club head at the leading edge, channel apex, and between the sole and front edge of the channel effects the spin rate of the golf ball and internal energy of the golf club head, thereby leading to improvements in ball speed and shot distance. Additionally, a stress test was performed at the same three locations in which the deflections were measured, to assess the stability of the normal channel in the control club head and the cambered channel of the exemplary club head. The stress test had negligible results, and the cambered channel of the exemplary club head proved to be equally as stable as the normal channel in the control club head.

The table above further displays the measured internal energy of the control club head and the exemplary club head, during impact with a golf ball, with the club head traveling at 115 mph. The internal energy of the exemplary club head was 3.8% higher than the internal energy of the control club head. This 3.8% increase in internal energy increases the ball speed by 0.65 mph, which equates to approximately 2 to 3 yards farther than a ball hit by the control club head.

The resulting spin rate of a golf ball struck by control club head and the exemplary club head were compared at two different impact locations, at a swing speed of 100 mph, wherein the first impact location is at a geometric center of the strike face and the second being at a point below the geometric center of the strike face. When striking a golf ball at the geometric center, the exemplary club head was found to reduce the spin rate of a golf ball by approximately 80 rpm over the control club head. The exemplary club head, having a cambered channel, reduces the spin rate of a golf ball by approximately 20-25%, when compared to the control club head, which comprises a channel void of a cambered rear wall. Further, the exemplary club head was found to reduce the spin rate of a golf ball by approximately 300 rpm over a similar golf club head devoid of a channel. The reduction of spin of a golf ball improves the distance travel by the golf ball. A reduction of 300 rpm in spin equates to approximately 2 yards more distance.

Example 2—Golf Club Head with Internal Radius Transition and Chamfer

An exemplary fairway wood type golf club head comprising a chamfer and a sole internal radius transition feature experienced approximately 4% to approximately 6% more internal energy generated during impact with a golf ball over a control club head devoid of a chamfer and sole internal radius transition feature.

The sole internal radius transition feature of the exemplary club head distributed the stress of the golf club head across a larger volume of material, thus lowering the localized peak stress of the strike face and sole. The chamfer allows increased bending of the crown and strike face of the club head on impact. Increased bending of the crown and strike face, due to the internal radius transition feature and chamfer, allows increased energy transfer to the golf ball and/or reduced spin on the golf ball resulting in increased travel distance.

The combined recoiling effect of the chamfer and internal radius transition feature, on the strike face provides: (1) a higher golf ball speed relative to the same club head speed of a club head without a chamfer and/or internal radius transition feature, due in part to the spring effect that is transferred from the hinged region to the strike face to the ball; (2) less spin of the golf ball after impact with the control club head, due in part to the hinge point of the chamfer countering more force from being absorbed, and instead transfers more force back to the ball, thereby preventing the ball from spinning backward off the strike face, (3) the internal radius transition feature distributes the stress of the golf club head across a larger volume of material, thus lowering the localized peak stress of the strike face and sole.

Example 3—Golf Club Head with Channel, Chamfer, and Internal Radius Transition

An exemplary fairway wood type golf club head comprising a generally triangular shaped channel with a cambered rear wall, similar to club head 100 with channel 132 discussed above, a chamfer, and a sole internal radius transition feature, located between the strike face and channel can experience drastic improvements in ball speed, face deflection, spin rates, and internal energy generated by striking a golf ball. Combining the individual improvements created by the channel, chamfer, and internal radius transition feature can lead to a high performance golf club head with high ball speed and low spin characteristics.

When a golf ball is struck with the exemplary fairway wood type golf club head, the stress at impact will spread across the face, towards the crown and sole. At the crown, the chamfer will allow the crown to hinge at the hinge point, relieving some of the stress at the strike face, while counter acting the back spin imparted on the ball by the strike face. At the sole, the stress at impact will be gradually relieved from the strike face by the sole internal radius transition feature and distributed into and across the channel, thus lowering the peak stress of the strike face. The cambered rear wall of the channel allows the leading edge of the golf club to flex down and back, helping transfer the stress of the strike face across the channel.

The distribution of stress in the golf club head, allows the strike face to be made thinner, thus allowing for a more bending of the strike face, which leads to higher ball speeds and longer shots. The combination of the all the energy store features (chamfer, channel with cambered rear wall, and sole internal radius transition feature) leads to higher internal energy of the golf club head, makes significantly higher ball speeds with lower spin rates achievable.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

While the above examples may be described in connection with a driver-type golf club, the apparatus, methods, and articles of manufacture described herein may be applicable to other types of golf club such as a fairway wood-type golf club, a hybrid-type golf club, an iron-type golf club, a wedge-type golf club, or a putter-type golf club. Alternatively, the apparatus, methods, and articles of manufacture described herein may be applicable other type of sports equipment such as a hockey stick, a tennis racket, a fishing pole, a ski pole, etc.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

Various features and advantages of the disclosure are set forth in the following claims.

The invention claimed is:

1. A golf club head comprising
- a hollow body;
- a strike face defining a loft plane;
- a heel region;
- a toe region opposite the heel region;
- a sole;
- a crown;
- a channel located behind the strike face and on the sole of the club head, the channel comprising:
  - a front edge adjacent to the sole;
  - a rear edge adjacent to the sole;
  - a main portion extending inward from the sole between the front edge and the rear edge, the main portion comprising:
    - a front wall, a rear wall, and an apex positioned along a tallest portion of the channel relative to the sole and extending from the heel region to the toe region, the apex separating the front wall from the rear wall, wherein:
    - the front wall extends from the front edge to the apex;
    - the rear wall extends from the rear edge to the apex; and
    - the rear wall is concave to the front wall;

wherein the sole and the channel are formed from a single material;

wherein the rear wall of the channel has a radius of curvature that is between 2.0 inches and 2.5 inches;

a chamfer extending between the strike face and the crown, the chamfer having an inner surface and an outer surface, the outer surface being an outer surface of the club head, and the inner surface defining a chamfer plane that is oriented at an angle of between 30 degrees and 60 degrees relative to the loft plane.

2. The golf club head of claim 1, wherein the channel comprises a height measured from a ground plane to the apex of the channel when the golf club head is positioned on the ground plane such that the sole is in contact with the ground plane; and wherein the height of the channel is constant from heel-to-toe.

3. The golf club head of claim 1, wherein the front wall comprises a thickness measured from an internal surface of the front wall to an external surface of the front wall;

wherein the thickness of the front wall increases when measured from the apex to the sole.

4. The golf club head of claim 1, wherein the apex comprises a thickness measured from an internal apex surface to an external apex surface; and;

wherein the thickness of the apex is not constant from heel to toe.

5. The golf club head of claim 1, wherein the front edge of the channel is offset from the strike face by a distance that is between 0.15 inches and 0.60 inches.

6. The golf club head of claim 1, wherein the chamfer comprises:

a width of between approximately 0.75 inches and approximately 3.50 inches;

a length of between approximately 0.05 inches and approximately 0.25 inches;

a maximum thickness of between approximately 0.025 inches and approximately 0.070 inches, wherein the maximum thickness is measured between the inner surface and the outer surface of the chamfer.

7. The golf club head of claim 6, wherein a ratio of the maximum thickness of the chamfer to a thickness of the crown, measured adjacent to the chamfer is between approximately 1.15 and 3.00.

8. A golf club head comprising a hollow body;

a strike face defining a loft plane;

a heel region;

a toe region opposite the heel region;

a sole;

a crown;

a channel located behind the strike face and on the sole of the club head, the channel comprising:

a front edge adjacent to the sole;

a rear edge adjacent to the sole;

a main portion extending inward from the sole between the front edge and the rear edge, the main portion comprising:

a front wall, a rear wall, and an apex positioned along a tallest portion of the channel relative to the sole and extending from the heel region to the toe region, the apex separating the front wall from the rear wall, wherein:

the front wall extends from the front edge to the apex;

the rear wall extends from the rear edge to the apex; and the rear wall is concave to the front wall;

wherein the sole and the channel are formed from a single material;

wherein the rear wall of the channel has a radius of curvature that is between 2.0 inches and 2.5 inches;

a chamfer extending between the strike face and the crown, the chamfer having an inner surface and an outer surface, the outer surface being an outer surface of the club head, and the inner surface defining a chamfer plane that is oriented at an angle of between 30 degrees and 60 degrees relative to the loft plane;

a transition region extending rearward from the strike face to the sole and between the strikeface and the channel, the transition region comprising:

a first tier extending from the strike face;

a first tier transition region extending from the first tier opposite the strike face;

a second tier extending from the first tier transition region opposite the first tier;

wherein:

the first tier comprises a first thickness that is substantially constant or decreasing from the strike face to the first tier transition region;

the second tier comprises a second thickness that is substantially constant or decreasing from the first tier transition region, wherein the second thickness is smaller than the first thickness.

9. The golf club head of claim 8, wherein:

a first tier length of the first tier is approximately equal to a second tier length of the second tier; and the first and second tier lengths are measured in a direction from the strike face towards a rear of the golf club head.

10. The golf club head of claim 8, wherein:

the first tier is longer than the second tier, as measured in a direction from the strike face towards a rear of the golf club head.

11. The golf club head of claim 8, wherein:

the first tier transition comprises a first arcuate surface extending from the first tier and a second arcuate surface extending from the second tier.

12. The golf club head of claim 8, wherein the channel comprises a height measured from a ground plane to the apex of the channel when the golf club head is positioned on the ground plane such that the sole is in contact with the ground plane; and wherein the height of the channel is constant from heel-to-toe.

13. The golf club head of claim 8, wherein the front wall of the channel comprises a thickness measured from an internal surface of the front wall to an external surface of the front wall;

wherein the thickness of the front wall increases when measured from the apex to the sole.

14. The golf club head of claim 8, wherein the front edge of the channel is offset from the strike face by a distance that is between 0.15 inches and 0.60 inches.

15. The golf club head of claim 8, wherein the chamfer comprises:

a width of between approximately 0.75 inches and approximately 3.50 inches;

a length of between approximately 0.05 inches and approximately 0.25 inches;

a maximum thickness of between approximately 0.025 inches and approximately 0.070 inches, wherein the maximum thickness is measured between the inner surface and the outer surface of the chamfer.

16. The golf club head of claim 15, wherein a ratio of the maximum thickness of the chamfer to a thickness of the crown, measured adjacent to the chamfer is between approximately 1.15 and 3.00.

17. The golf club head of claim 8, wherein the transition region further comprises:

a second tier transition region extending from the second tier opposite the first tier transition region;

a third tier directly abutting the second tier transition region opposite the second tier; and wherein the third tier comprises a third thickness that is substantially constant from the second tier transition region to the at least one of the sole or the crown, wherein the third thickness is smaller than the first thickness and the second thickness.

18. The golf club head of claim 17, wherein:

the first tier transition comprises a first arcuate surface extending from the first tier and a second arcuate surface extending from the second tier; and the second tier transition comprises a third arcuate surface extending from the second tier and a fourth arcuate surface extending from the third tier.

* * * * *